US007093651B2

(12) United States Patent
Meyers et al.

(10) Patent No.: US 7,093,651 B2
(45) **Date of Patent: *Aug. 22, 2006**

(54) WATER PRESSURE SYSTEM WITH PRESSURE TANK INSTALLED WITHIN WELL CASING OF WELL

(75) Inventors: Kenneth A. Meyers, Lena, WI (US); James A. Meyers, Oconto Falls, WI (US)

(73) Assignee: In-Well Technologies, Inc., Lena, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/160,506

(22) Filed: Jun. 27, 2005

(65) Prior Publication Data

US 2005/0226751 A1 Oct. 13, 2005

Related U.S. Application Data

(63) Continuation of application No. 10/082,899, filed on Feb. 25, 2002, now Pat. No. 6,910,532, which is a continuation-in-part of application No. 09/428,343, filed on Oct. 27, 1999, now Pat. No. 6,349,765.

(51) Int. Cl.
*E21B 43/00* (2006.01)

(52) U.S. Cl. ..... 166/85.2; 417/44

(58) Field of Classification Search ..... 166/68, 166/85.2, 88.1; 417/38, 44, 53, 44.2
See application file for complete search history.

(56) References Cited

U.S. PATENT DOCUMENTS

| | | | | |
|---|---|---|---|---|
| 2,273,505 | A | 2/1942 | Florian | 138/28 |
| 2,530,190 | A | 11/1950 | Carver | 138/26 |
| 2,695,753 | A | 11/1954 | Kirk, Jr. | 237/8 R |
| 2,796,939 | A | 6/1957 | Woodruff | 166/228 |
| 2,806,537 | A | 9/1957 | Sparks, Sr. | 166/196 |
| 2,979,070 | A | 4/1961 | Payne | 137/192 |
| 3,038,396 | A | 6/1962 | Jameson, Jr. et al. | 94/33 |
| 3,076,479 | A | 2/1963 | Kai | 138/30 |
| 3,261,296 | A | 7/1966 | Weber | 103/87 |
| 3,273,577 | A | 9/1966 | Moore | 137/13 |
| 3,299,831 | A | 1/1967 | Watson et al. | 103/220 |

(Continued)

*Primary Examiner*—William Neuder
(74) *Attorney, Agent, or Firm*—Alan D. Kamrath; Nikolai & Mersereau, P.A.

(57) ABSTRACT

A water pressure system includes a pressure tank installed underground within the well casing of a well. The water pressure system includes a submersible pump connected to the inlet of the pressure tank by a drop pipe. The outlet of the pressure tank is connected to a second drop pipe and in turn to a discharge pipe for distribution of pressurized water to a house or other building. A pressure switch is connected to the pressure tank for controlling the submersible pump. The pressure tank includes an outer sidewall with an inlet end and an outlet end. A flexible diaphragm bladder located within the outer sidewall is connected between the inlet and outlet of the tank. In a first embodiment, a tube extends through the center of the bladder between an inlet opening and an outlet opening. The tube has a plurality of holes therein to allow water to flow into and out of the flexible bladder. Pressurized air fills the space between the bladder and the outer sidewall to pressurize the water in the bladder. The pressure tank may be used in combination with a flow control valve, a relief valve, a flow control valve incorporating a relief valve, a standard submersible pump, and/or a variable speed submersible pump to provide and maintain a constant flow of water at a constant pressure through the system.

20 Claims, 19 Drawing Sheets

U.S. PATENT DOCUMENTS

| | | | | |
|---|---|---|---|---|
| 3,376,898 | A | 4/1968 | Hugley | 138/137 |
| 3,394,733 | A | 7/1968 | Jacuzzi | 137/568 |
| 3,442,292 | A | 5/1969 | Jacuzzi | 138/30 |
| 3,514,220 | A | 5/1970 | Hahn, Jr. | 417/151 |
| 3,536,102 | A | 10/1970 | Allweitz et al. | 138/30 |
| 3,543,854 | A | 12/1970 | Degen | 166/228 |
| 3,621,882 | A | 11/1971 | Kupiec | 138/30 |
| 3,708,965 | A | 1/1973 | Domnick | 55/488 |
| 3,814,543 | A | 6/1974 | Gritz | 417/26 |
| 4,036,616 | A | 7/1977 | Byrns | 55/498 |
| 4,094,789 | A | 6/1978 | Kemper | 210/188 |
| 4,322,230 | A | 3/1982 | Schoen et al. | 55/316 |
| 4,431,052 | A | 2/1984 | James | 166/112 |
| 4,583,594 | A | 4/1986 | Kojicic | 166/228 |
| 4,936,383 | A | 6/1990 | Towner et al. | 166/68 |
| 5,190,108 | A | 3/1993 | Mansuy | 166/371 |
| 5,262,065 | A | 11/1993 | Hansen | 210/747 |
| 5,281,101 | A | 1/1994 | Bevington | 417/38 |
| 5,353,949 | A | 10/1994 | Seibert et al. | 220/371 |
| 5,411,084 | A | 5/1995 | Padden | 166/230 |
| 5,782,299 | A | 7/1998 | Simone et al. | 166/230 |
| 5,803,174 | A | 9/1998 | Gilmore et al. | 166/292 |
| 5,820,762 | A | 10/1998 | Bamer et al. | 210/661 |
| 5,899,271 | A | 5/1999 | Simone et al. | 166/230 |
| 5,937,944 | A | 8/1999 | Simone et al. | 166/230 |
| 5,988,984 | A | 11/1999 | Austin | 417/44.2 |
| 6,109,349 | A | 8/2000 | Simone et al. | 166/230 |
| 6,202,750 | B1 | 3/2001 | Ohanesian | 166/236 |
| 6,217,639 | B1 | 4/2001 | Jackson | 96/134 |
| 6,328,071 | B1 | 12/2001 | Austin | 138/30 |
| 6,349,765 | B1 * | 2/2002 | Meyers et al. | 166/85.2 |
| 6,418,969 | B1 | 7/2002 | Bertagna | 138/30 |
| 6,422,822 | B1 | 7/2002 | Holmes | 417/9 |
| 6,595,277 | B1 | 7/2003 | Zins et al. | 166/75.13 |
| 6,684,945 | B1 | 2/2004 | Meyers | 166/75.13 |
| 6,910,532 | B1 | 6/2005 | Meyers et al. | 168/85.2 |

* cited by examiner

WATER PRESSURE SYSTEM WITH PRESSURE TANK INSTALLED WITHIN WELL CASING OF WELL

CROSS-REFERENCE TO RELATED APPLICATIONS

This application is a continuation of application Ser. No. 10/082,899, filed Feb. 25, 2002, now U.S. Pat. No. 6,910,532, which is a continuation-in-part of application Ser. No. 09/428,343 filed Oct. 27, 1999, now U.S. Pat. No. 6,349,765, the disclosures of which are incorporated herein by reference.

BACKGROUND OF THE INVENTION

The present invention relates to water pressure systems for water wells, and more particularly, to a pressure tank installed underground within the well casing of a well for storing water under pressure for distribution and use.

A typical water pressure system for residential use is established by first drilling a hole in the ground in search of water from a water bearing aquifer. Once water is reached by the drill, a well casing is inserted into the bore hole to preserve the sides of the well. A submersible pump is then inserted into the well below the water level to pump water from the aquifer. One end of a drop pipe is attached to the submersible pump to draw water out of the well. The other end of the drop pipe is attached to a pitless adapter, which is attached to a discharge pipe for carrying water to a pressure tank located outside above ground or inside a building.

The pressure tank holds a reserve supply of water under pressure within the tank. A pressure switch coupled to the tank is used to maintain water pressure in the tank between a minimum value and a maximum value. The water is stored in the tank under pressure until it is needed. As water is drawn from the tank, the pressure in the tank decreases. The pressure switch activates the submersible pump to pump water into the tank when the water pressure in the tank drops below the minimum value. As water is pumped back into the tank, pressure in the tank increases to the maximum value. When the pressure reaches the maximum value, the pressure switch stops the pump from pumping water into the tank.

Pressure tanks are normally of substantial size, and consequently are limited to above ground installations in most water pressure systems. Typically, pressure tanks are installed outside above ground, in the basement of a house or in a separate building to protect it from the elements. Adverse weather conditions can effect the reliability of a pressure tank in cold weather climates. During the winter months, the pressure tanks must be protected from the cold and snow. Therefore, the pressure tanks for use in cold weather climates are either installed in a basement or in an insulated building above ground.

However, there are problems associated with above ground installations of pressure tanks. The large pressure tanks are usually quite expensive, cumbersome and difficult to install. The installation of a pressure tank above ground in cold weather climates may lead to freezing problems that require the tank be wrapped in insulation and heat tape or require the tank be installed in the basement of a house or a separate insulated building. Installation of a pressure tank in the basement or other area of a house takes up valuable space in the home. Installation of a pressure tank in a separate insulated building would require construction of the building. Thus, the installation of a pressure tank is often quite difficult and time-consuming.

Water pressure tanks installed underground are known in the art. For example, U.S. Pat. No. 3,394,733 to Jacuzzi discloses an airless water pressure system utilizing an underground pressure tank. The pressure tank of this invention includes an expansible tube installed around a pipe having openings therein to transfer liquid from the pipe to the expansible tube. The tube is clamped at each end to allow the liquid under pressure to cause expansion of the tube. However, the clamped ends of the tube have been known to fail under pressure from the liquid. In another patent to Jacuzzi, U.S. Pat. No. 3,442,292 discloses a pressure tank installed underground in a well, having water flowing into the pressure tank around an air filled bladder. The problem with this patented invention is the pressure tank is positioned at the top of the well, which could cause freezing problems in cold climates.

Accordingly, there is a need for a water pressure system that allows for installation of a pressure tank underground in the well casing of a well that is less expensive, easier to install and maintain, and more reliable than prior art water pressure systems.

SUMMARY OF THE INVENTION

The present invention provides a pressure tank installed within the well casing of a well. The pressure tank has an outside diameter to fit inside a well casing having an inner diameter greater than the outside diameter of the pressure tank.

The water pressure system of the present invention pumps water from a water bearing aquifer to a pressure tank installed underground within the well casing of a well. The water pressure system of the present invention includes several different embodiments. A first embodiment includes a submersible pump installed in the well below the water level to pump water from the aquifer. One end of a first drop pipe is attached to the submersible pump, while the other end of the first drop pipe is attached to an inlet end of a pressure tank installed in the well casing of the well. Water flows from the submersible pump through the drop pipe and into the pressure tank. The water enters the pressure tank through an inlet opening, and is either stored in the tank for future use, or continues to flow out through an outlet opening in the tank. One end of a second drop pipe is connected to an outlet end of the tank. The other end of the second drop pipe is connected to a discharge pipe for distribution of water from the well.

A first embodiment of the pressure tank includes a main body having an inlet end, an outlet end, and an outer sidewall. Attached to the inlet end of the tank are an inlet end cap and an inlet plug. The inlet plug is inserted within the inlet end cap. A flexible diaphragm bladder is connected between the inlet plug and the outlet end cap. A center pipe extends through the center of the flexible diaphragm bladder between an inlet opening and an outlet opening. The center pipe has a plurality of holes therein to allow water to flow through the tube and into and out of the flexible bladder. The inlet opening of the diaphragm bladder is clamped to a ribbed end of the inlet plug with a clamping device. The outlet opening of the diaphragm bladder is clamped to a ribbed end of the outlet end cap with a similar clamping device. Pressurized air fills the empty space between the bladder and the outer sidewall of the tank to pressurize the water in the flexible bladder.

The outlet end of the drop pipe opposite the end connected to the submersible pump is connected to the inlet plug extending through the inlet end cap of the pressure tank. The other end of the inlet plug is connected to the inlet end of the diaphragm bladder. The outlet end of the diaphragm bladder is attached to the outlet end cap. Water flows through the openings in the inlet end cap, inlet plug, diaphragm bladder, and outlet end cap to a second drop pipe connected to the outlet end cap of the tank. The other end of the second drop pipe may be connected to a pitless adapter, which in turn is connected to a discharge pipe.

A pressure switch coupled to the pressure tank regulates water pressure in the pressure tank by maintaining the water pressure between a minimum value and a maximum value. The pressure switch continuously monitors the water pressure in the tank, and controls the submersible pump accordingly. The pressure switch responds to a drop in pressure below the minimum value by starting the pump to replenish the water in the tank and to build up the water pressure to its maximum value. The pressure switch stops the pump when the water pressure reaches the maximum value and restarts the pump when the pressure drops below the minimum value.

The first embodiment may be used in combination with a relief valve and a flow control valve, a flow control valve with an integral relief valve incorporated therein, or a submersible variable speed pump.

A second embodiment of a pressure tank includes a tank with water on the outside of the bladder. The original tank, with water on the inside of the bladder, is preferably used in wells having an outer diameter of five inches or more, preferably five to six inches. This second embodiment with water on the outside of the bladder is preferably used in wells having an outer diameter of less than five inches, preferably three to four inches. This embodiment does not include a center pipe extending through the center of the tank, yet provides the same amount of storage capacity as the first embodiment. The second embodiment is also easier and less expensive to manufacture, install, repair, and/or replace than the first embodiment.

The second embodiment may also be used in combination with a relief valve and a flow control valve, a flow control valve with an integral relief valve incorporated therein, or a submersible variable speed pump.

The present invention also contemplates new methods and apparatus for attaching or sealing the bladder to the pressure tank ends. In one embodiment, the bladder is held in place at the top and bottom ends with clamps. At least one clamp is strapped around the bladder at the top and bottom ends of the tank. In another embodiment, the top and bottom of the bladder are sealed between flexible fittings at the ends of the tank. This design allows for easy repair and/or replacement of the bladder. The bladder is replaced by removing the top of the tank, undoing the clamps and/or fittings, and lifting the bladder out. This design is also easier to construct and install than other designs. In yet another embodiment, the bladder includes end caps at the top and bottom. Brackets attach the end caps to the top and bottom of the tank. At least one clamp is attached around the bladder at the top and bottom end caps, securing the bladder in place. An anchor system attaches the bottom end cap to the bottom of the tank and prevents the bladder from moving to the top of the tank.

The present invention provides a constant flow of water through the system and prevents the pump from cycling on and off from irregular or intermittent use. The present invention may also be used in liquid systems other than water, such as fuel dispensing systems.

Various other features, objects, and advantages of the invention will be made apparent to those skilled in the art from the following drawings and detailed description of the invention.

DETAILED DESCRIPTION OF THE INVENTION

Figure 1A:
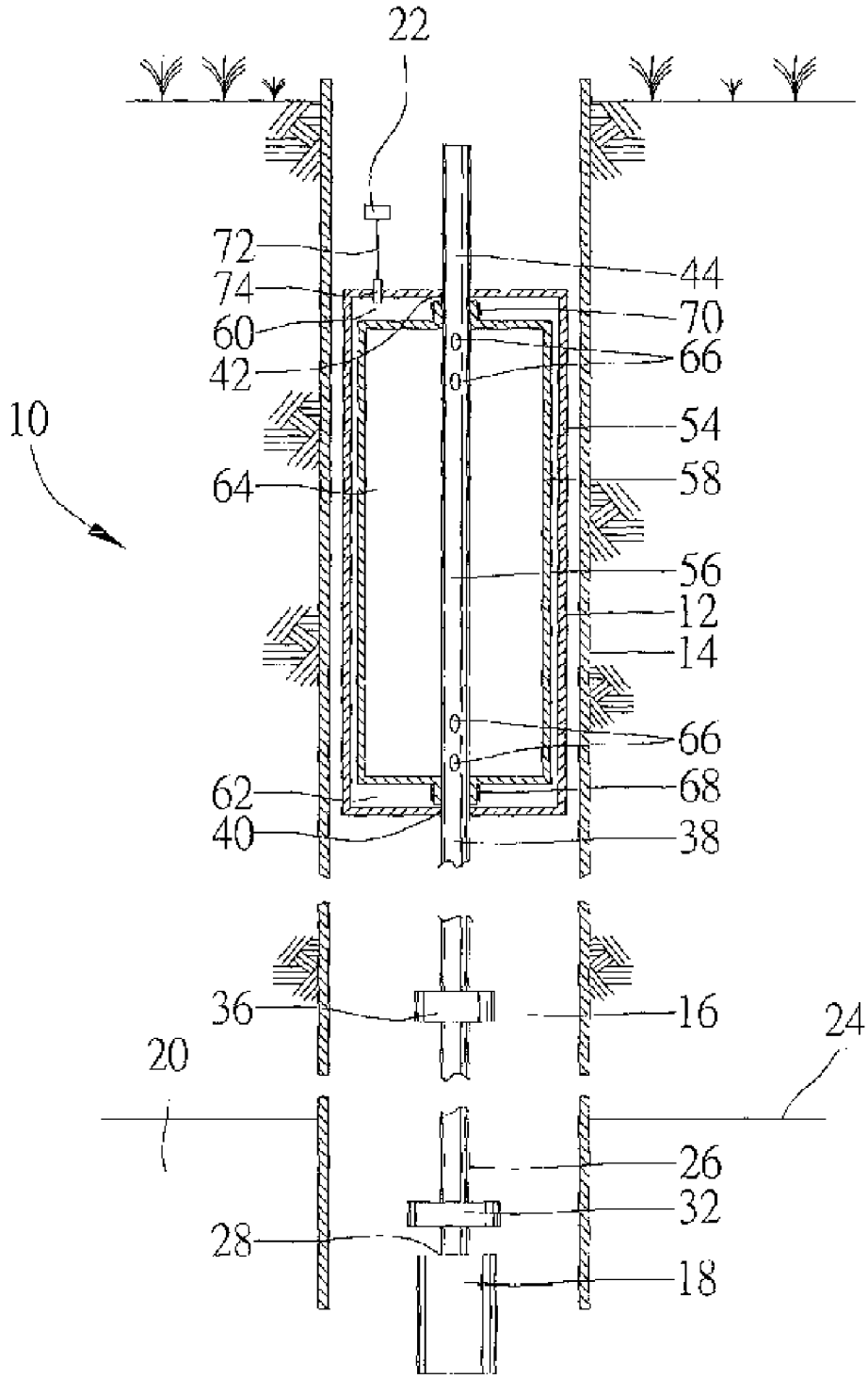
FIG. 1A is a partial cross-sectional schematic representation of a water pressure system according to a first embodiment of the present invention, showing a pressure tank installed within the well casing of a well at maximum storage capacity.
Figure 1B:
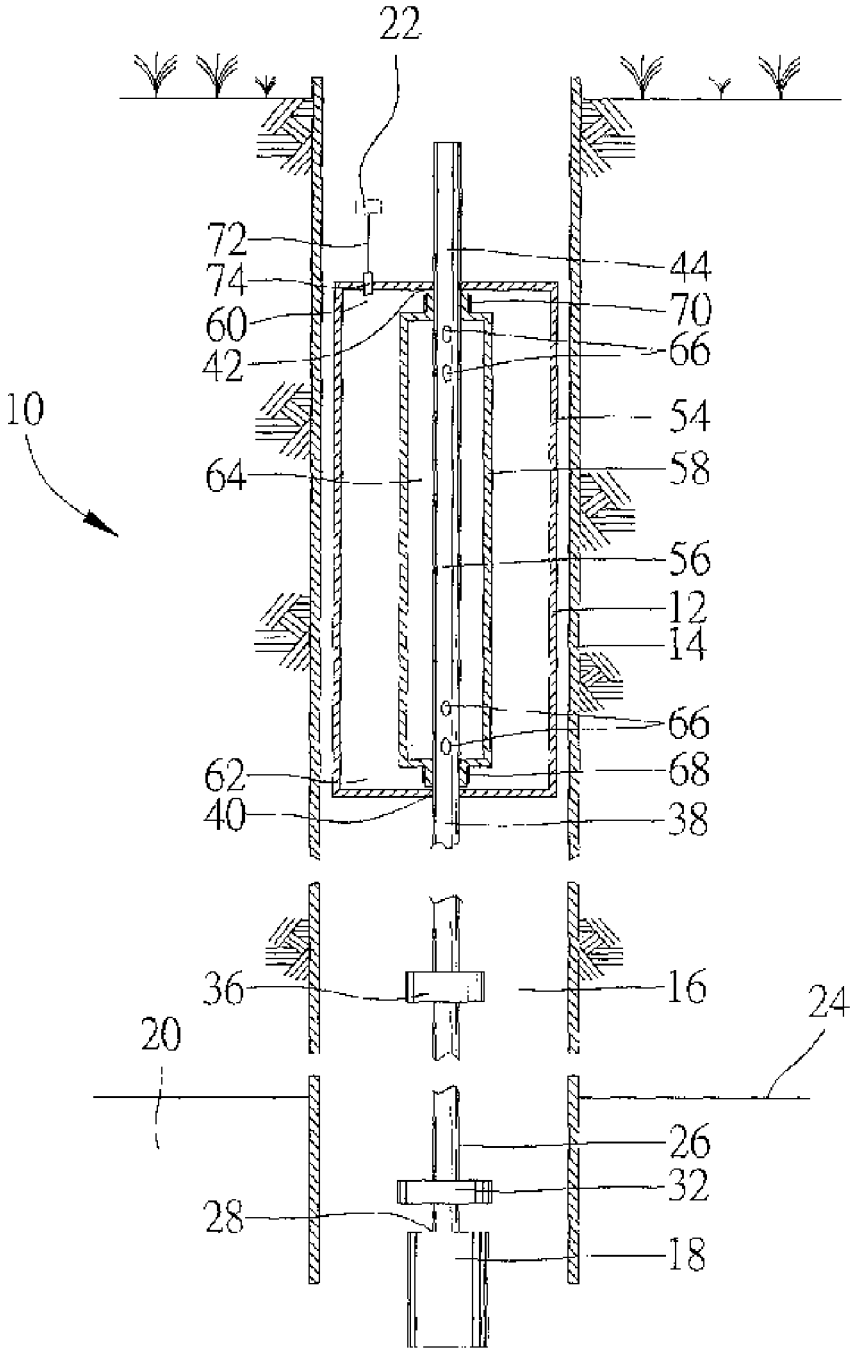
FIG. 1B is a partial cross-sectional schematic representation of the water pressure system of FIG. 1A, showing the pressure tank at minimum storage capacity.

FIGS. 1A and 1B illustrate a schematic representation of one embodiment of a water pressure system 10 comprising a pressure tank 12 installed within the well casing 14 of a well 16. FIG. 1A shows the tank 12 at a maximum storage capacity, while FIG. 1B shows the tank 12 at a minimum storage capacity. The pressure tank 12 can vary in size, but must have a small enough outer diameter to fit inside the inner diameter of the well casing 14. Most well casings have an inner diameter that range from approximately three to eight inches. The pressure tank embodiments of the present invention preferably have an outer diameter that range from approximately three to seven inches and have a length of up to ten feet or more. The pressure tank can be placed at any depth in the well and has a typical draw down storage capacity of approximately one to three gallons. A first pressure tank embodiment that stores water on the inside of a flexible diaphragm bladder, as shown in FIGS. 1A, 1B, 2A, 2B, 3A, 3B, 4, 5, 7, 9A and 9B, is preferably designed for well casings having an inner diameter of approximately five inches or more. Another pressure tank embodiment that stores water on the outside of the flexible diaphragm bladder, as shown in FIGS. 10A, 10B, 11A, 11B, 12A, 12B and 13, is preferably designed for well casings having an inner diameter of approximately less than five inches. The pressure tank embodiments of the present invention are reduced in size, more reliable, less expensive to manufacture and install, and more easily maintained than prior art pressure tanks.

The water pressure system of the present invention preferably operates within a specific range of pressure. The pressure range is achieved with a pressure switch, which turns on the pump when the pressure reaches a preset minimum value and turns off the pump when the pressure reaches a preset maximum value. Water that enters the pressure tank is either stored under pressure in the tank for future use, or continues to flow out through the tank to a discharge pipe for distribution and use. As water is drawn from the system, water is released from the pressure tank, and the pressure drops to the minimum pressure level, causing the pressure switch to close, starting the pump to refill the pressure tank. As the pressure tank is filled, the pressure increases to the maximum pressure level and the pressure switch opens, stopping the pump.

The water pressure system 10 of FIGS. 1A and 1B, comprises a submersible pump 18 installed in a well 16 for pumping water from a water bearing aquifer 20 through a relief valve 32 and a flow control valve 36 to a pressure tank 12 installed in the well casing 14 of the well 16. Water from the pressure tank 12 flows to a discharge pipe (not shown) for distribution and use.

The output 28 of the submersible pump 18 is connected to the relief valve 32. The relief valve 32 is preferably installed below the pumping water level 24 right above the submersible pump 18, so that the relief valve 32 is always under water, preventing mineral deposits from forming on the relief valve 32 that could adversely affect water quality. The relief valve 32 releases excess pressure in the system and limits back pressure from building up in the submersible pump, especially on the motor bearings of the pump, which could fail if the relief valve was not installed in the system. A first drop pipe 26 preferably connects the relief valve 32 to the flow control valve 36. The flow control valve 36 controls output flow from the pump 18 and relief valve 32. The flow control valve 36 maintains constant water pressure in the system and automatically adjusts the pump's output to match the flow requirements of the system. The flow control valve 36 also extends pump life by eliminating pump cycling, eliminating changes in water pressure and eliminating the need for a large storage pressure tank. A tank inlet drop pipe 38 connects the flow control valve 36 to an inlet end 40 of the pressure tank 12. A tank outlet drop pipe 44 preferably connects an outlet end 42 of the pressure tank 12 to a pitless adapter 50 which is further connected to a discharge pipe 52 (shown in FIG. 4) for distributing pressurized water from the pressure tank 12.

Figure 4:
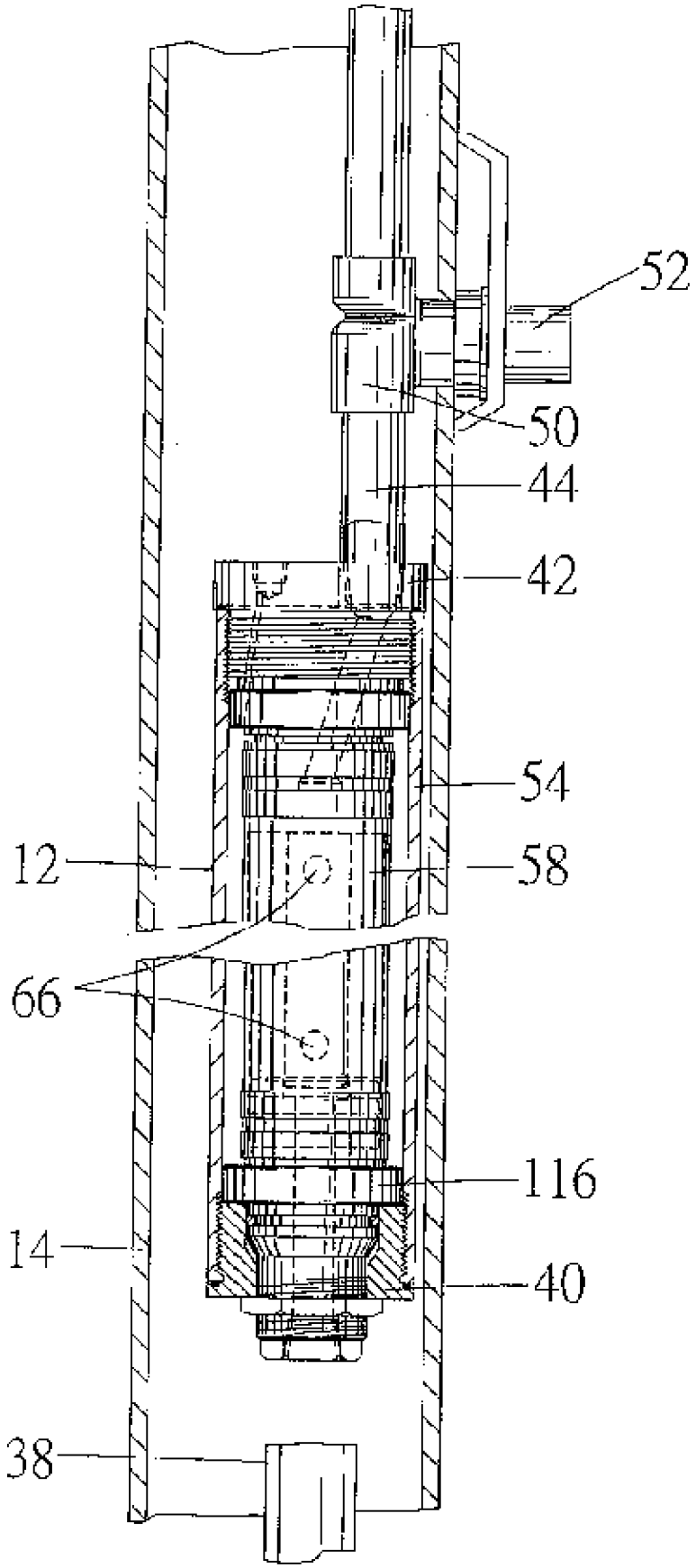
FIG. 4 is a partial cross-sectional view of a first embodiment of a pressure tank according to the present invention.
Figure 5:
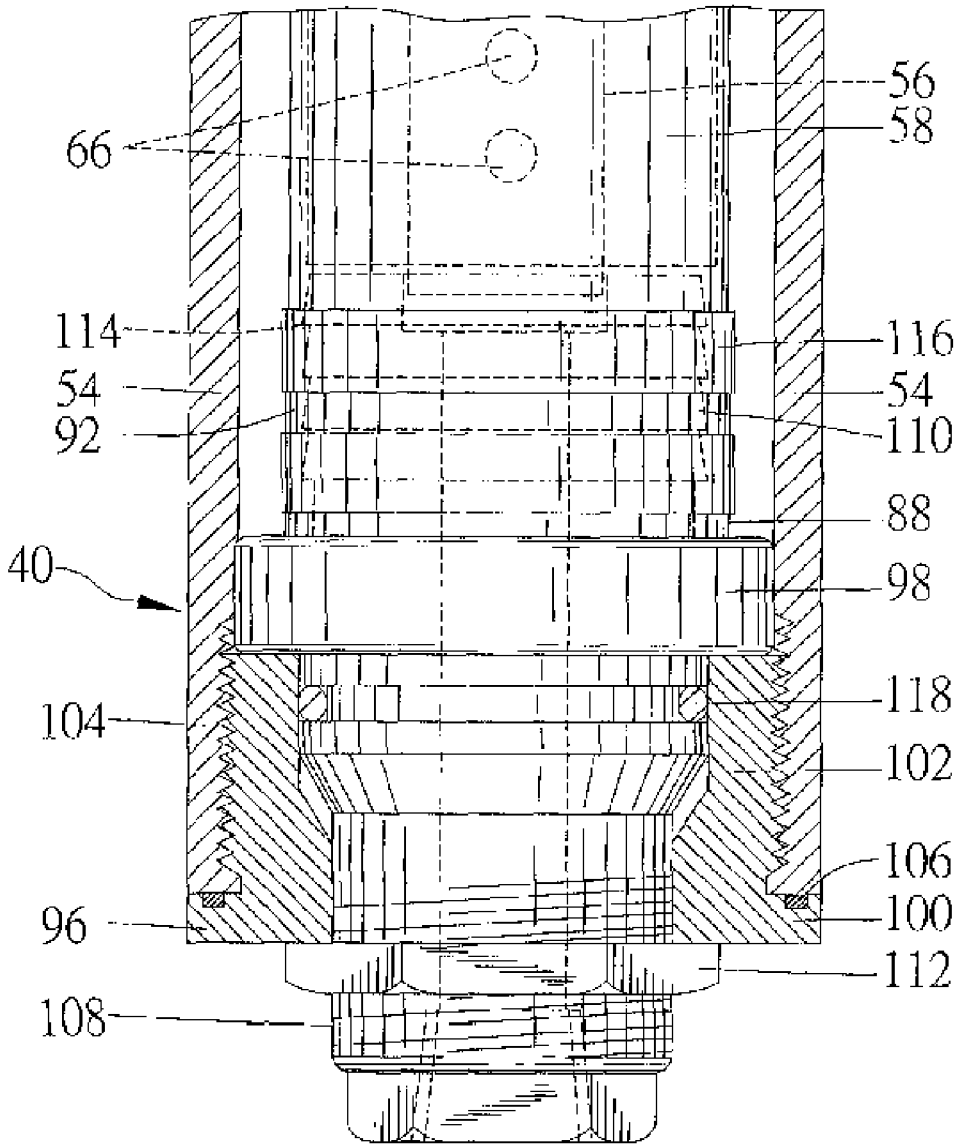
FIG. 5 is an enlarged partial cross-sectional view of the inlet end of the pressure tank of FIG. 4.

The pressure tank 12 comprises an outer sidewall 54 with the inlet end 40 and the outlet end 42, a center pipe 56 extending though the inlet end 40, outlet end 42 and outer sidewall 54, and a flexible diaphragm bladder 58 surrounding the center pipe 56. The inlet end 40 and the outlet end 42 are sealed to the outer sidewall 54 at both ends of the pressure tank 12. The flexible diaphragm bladder 58 separates the inner space 60 of the tank 12 into an air chamber 62 on the outside of the flexible diaphragm bladder 58, and a water chamber 64 on the inside of the flexible diaphragm bladder 58 surrounding the center pipe 56. The center pipe 56 includes a plurality of openings 66 extending therethrough to allow water to flow into and out of the water chamber 64 as pressure in the tank 12 varies. These openings 66 allow water to enter the water chamber 64 on an increase in system pressure, and allow water to exit the water chamber 64 on a decrease in system pressure. As the system pressure increases, the flexible diaphragm bladder 58 expands into the air chamber allowing for the storage of water in the water chamber 64, as is shown in FIG. 1A. As the system pressure decreases, the pressurized air chamber 62 forces the flexible diaphragm bladder 58 to contract, forcing water out through the plurality of openings 66 in the center pipe 56 to the discharge pipe 52, as is shown in FIG. 1B. The flexible diaphragm bladder 58 is sealed to the inlet end 40 of the tank 12 with at least one bottom clamp 68 and is sealed to the outlet end 42 of the tank 12 with at least one top clamp 70, as shown in FIGS. 4, 5 and 7. The details of attaching and sealing the flexible diaphragm bladder 58 to the inlet and outlet ends 40 and 42 of the tank 12 are discussed below in relation to FIGS. 4–8. Alternative embodiments for attaching and sealing the flexible diaphragm bladder to the inlet and outlet ends of the tank are shown in FIGS. 9A, 9B, 10A, 10B, 11A, 11B, 12A and 12B. The air chamber 62 in the tank 12 surrounding the flexible diaphragm bladder 58 is pre-charged with pressurized air to a preset amount depending on the desired operating pressure. An air line 72 extends through the outlet end 42 of the tank 12 into the air chamber 62 and is coupled to an air valve 74 for charging the air chamber 62 with pressurized air. A pressure switch 22 is also coupled to the air line 72 to monitor the pressure within the air chamber 62 of the tank 12 and to control operation of the submersible pump 18 by turning it off and on according to pressure changes in the system.

The pressure switch 22 coupled to the pressure tank 12 regulates water pressure in the system by maintaining the water pressure between a preset minimum value and a preset maximum value. The pressure switch 22 continuously monitors the pressure and controls the submersible pump 18 accordingly. The pressure switch 22 responds to a drop in pressure below the minimum value by starting the pump 18 to replenish the water in the tank 12 and to build up the water pressure to the maximum value. The pressure switch 22 stops the pump 18 when the water pressure reaches the maximum value and restarts the pump 18 when the pressure drops below the minimum value.

Figure 2A:
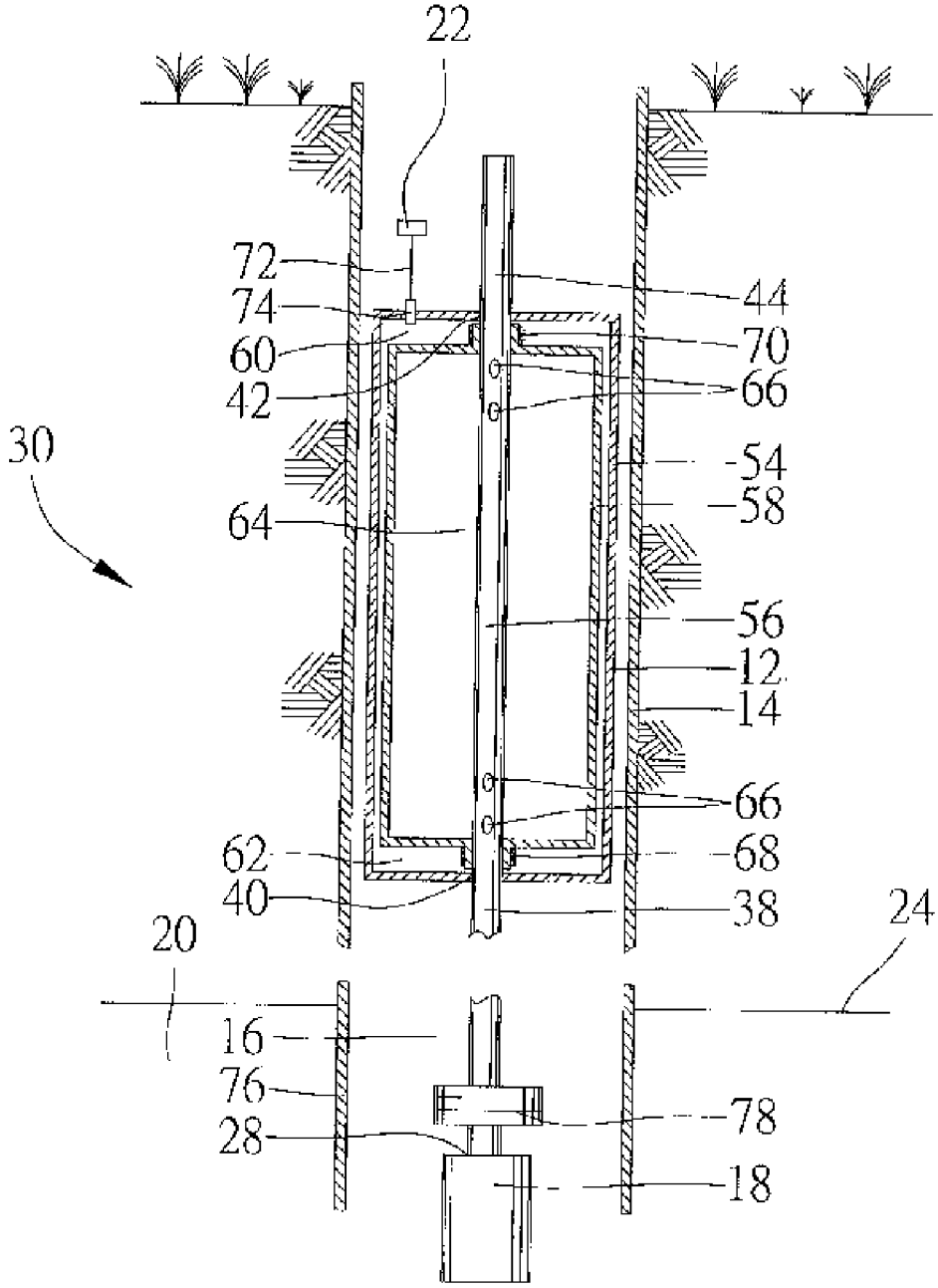
FIG. 2A is a partial cross-sectional schematic representation of a water pressure system according to a second embodiment of the present invention, showing a pressure tank installed within the well casing of a well at maximum storage capacity.
Figure 2B:
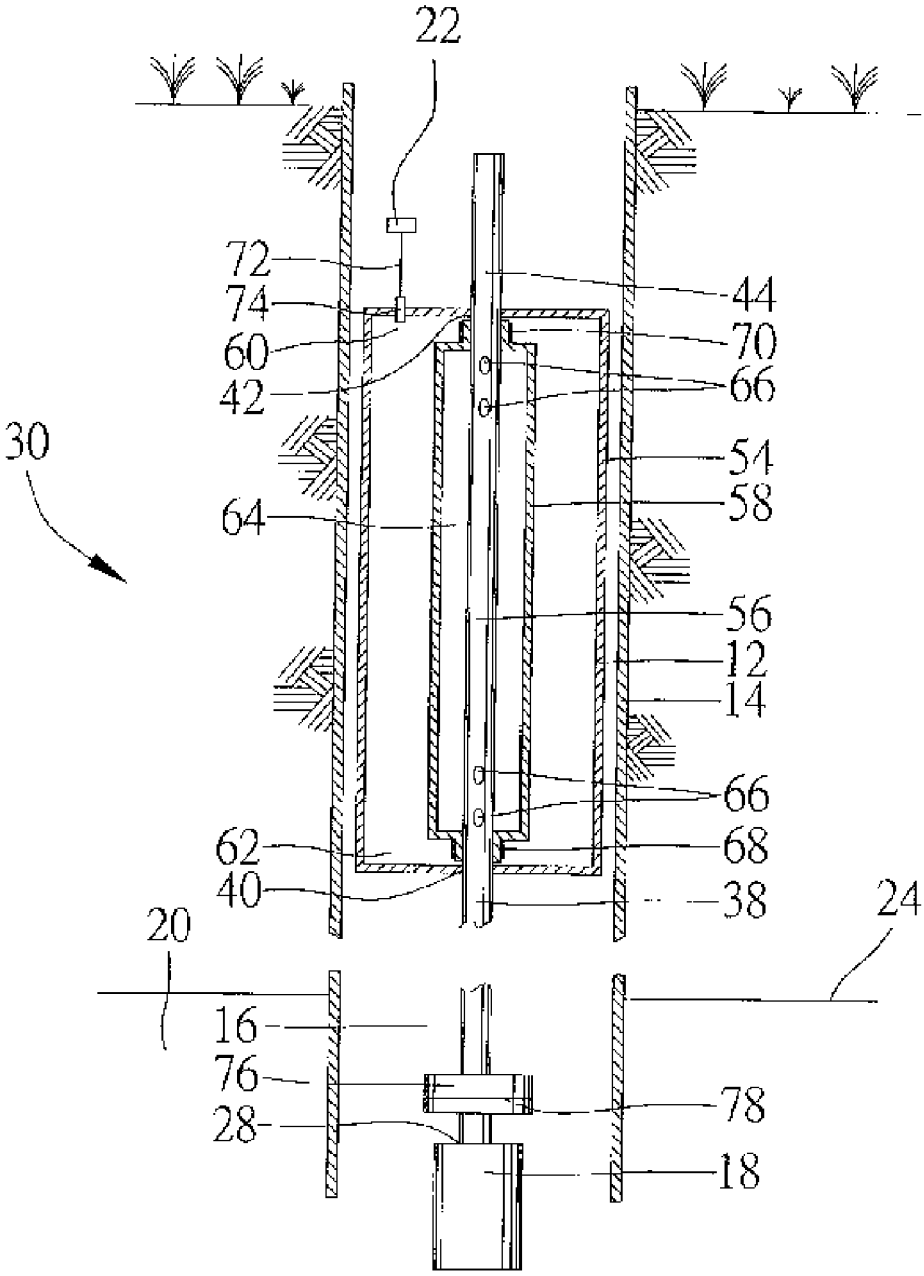
FIG. 2B is a partial cross-sectional schematic representation of the water pressure system of FIG. 2A, showing the pressure tank at minimum storage capacity.

FIGS. 2A and 2B illustrate a schematic representation of another embodiment of a water pressure system 30 having a pressure tank 12 installed within the well casing 14 of a well 16. FIG. 2A shows the tank 12 at maximum storage capacity, while FIG. 2B shows the tank 12 at minimum storage capacity. This embodiment includes the use of a flow control valve 76 with an integral relief valve 78 incorporated therein.

The water pressure system 30 of FIGS. 2A and 2B, comprises a submersible pump 18 installed in a well 16 for pumping water from a water bearing aquifer 20 through a flow control valve 76 with an integral relief valve 78 to a pressure tank 12 installed in the well casing 14 of the well 16. Water from the pressure tank 12 flows to a discharge pipe (not shown) for distribution and use.

The output 28 of the submersible pump 18 is connected to the flow control valve 76 with integral relief valve 78. The flow control valve 76 with integral relief valve 78 is preferably installed below the pumping water level 24 right above the submersible pump 18, so that the flow control valve 76 with integral relief valve 78 is always under water, preventing mineral deposits from forming on the relief valve 78 that could adversely affect water quality. The relief valve 78 releases excess pressure in the system and limits back pressure from building up in the submersible pump, especially on the motor bearings of the pump, which could fail if the relief valve was not installed in the system. The flow control valve 76 controls output flow from the pump 18. The flow control valve 76 maintains constant water pressure in the system and automatically adjusts the pump's output to match the flow requirements of the system. The flow control valve 76 also extends pump life by eliminating pump cycling, eliminating changes in water pressure and eliminating the need for a large storage pressure tank. A tank inlet drop pipe 38 connects the flow control valve 76 with integral relief valve 78 to the inlet end 40 of the pressure tank 12. A tank outlet drop pipe 44 preferably connects the outlet end 42 of the pressure tank 12 to a discharge pipe (not shown) for distributing pressurized water from the pressure tank 12.

Figure 3A:
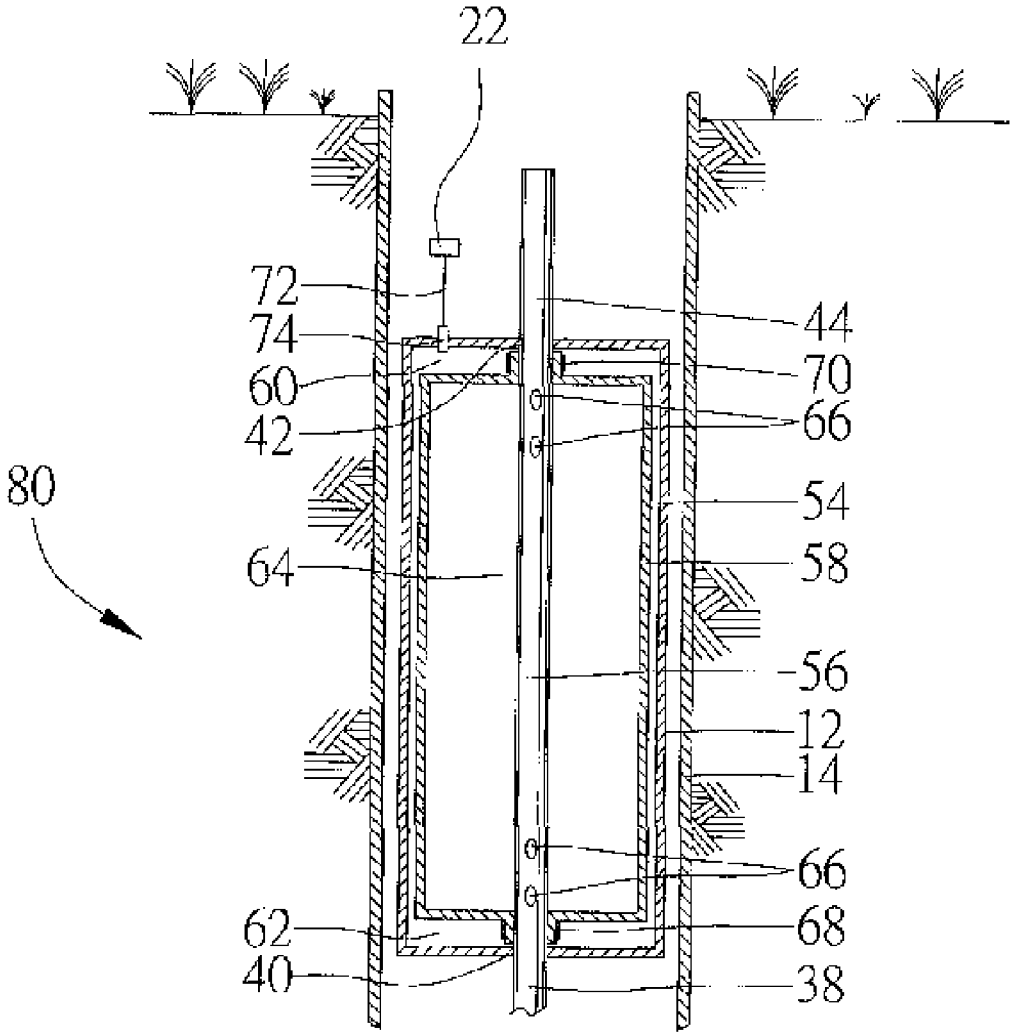
FIG. 3A is a partial cross-sectional schematic representation of a water pressure system, according to a third embodiment of the present invention, showing a pressure tank installed within the well casing of a well at maximum storage capacity.
Figure 3A:
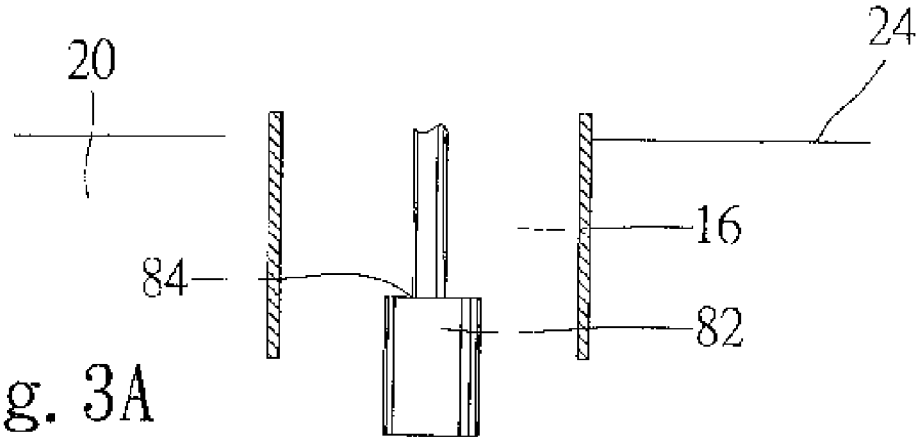
Figure 3B:
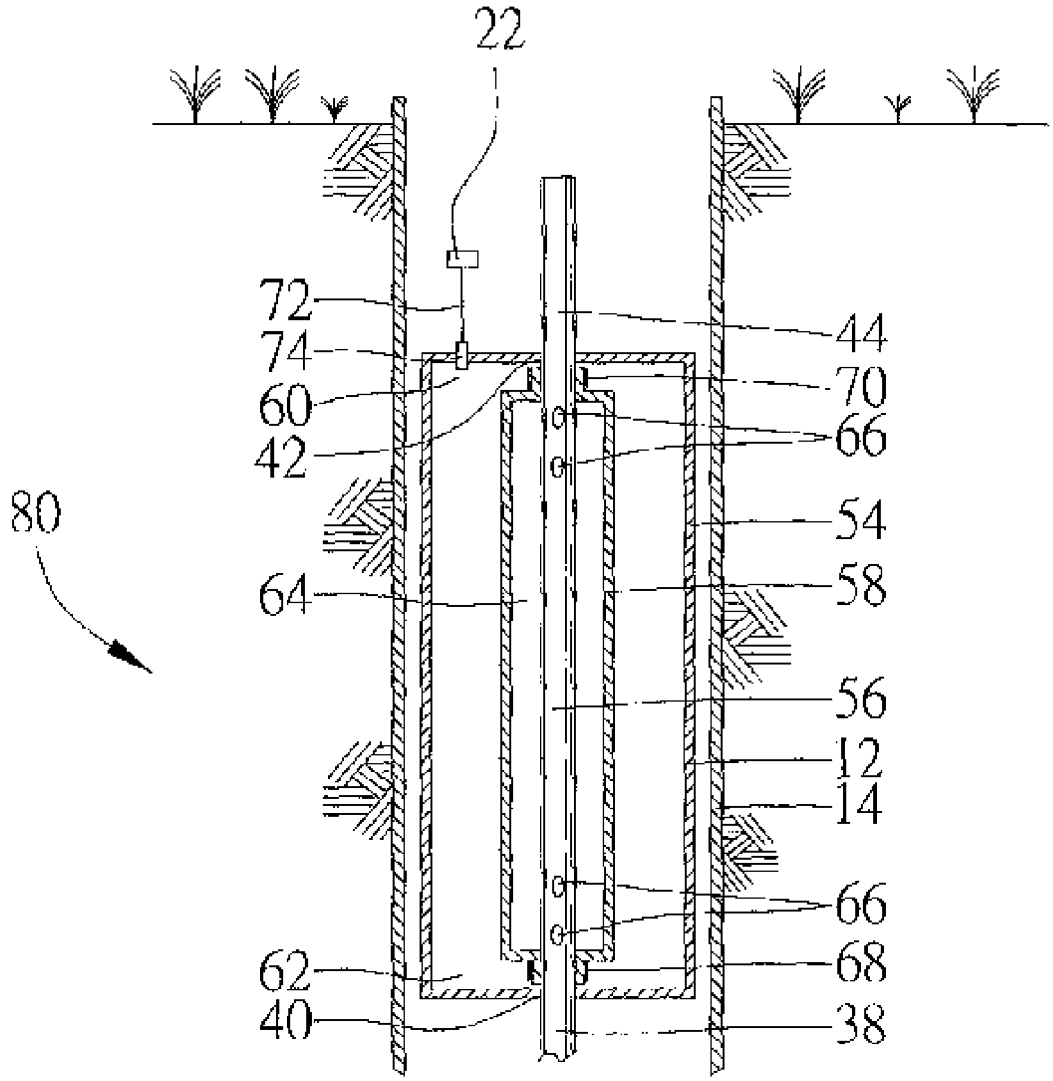
FIG. 3B is a partial cross-sectional schematic representation of the water pressure system of FIG. 3A, showing the pressure tank at minimum storage capacity.
Figure 3B:
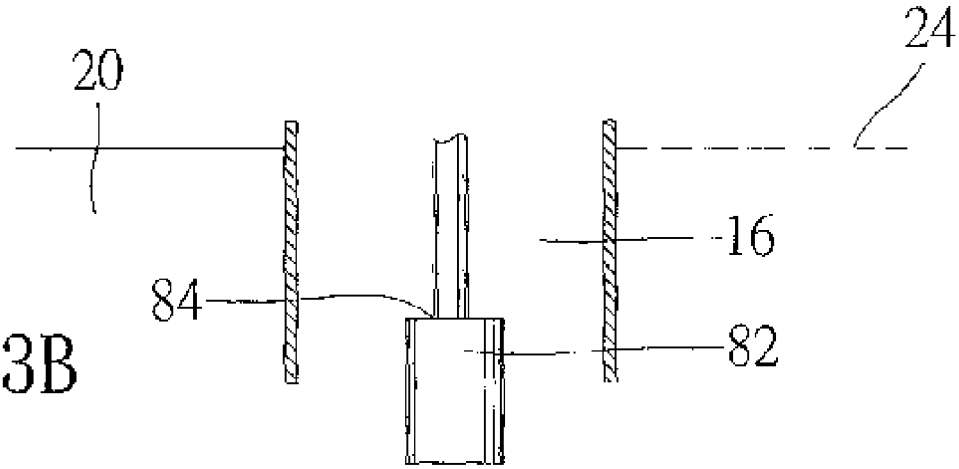

FIGS. 3A and 3B illustrate a schematic representation of yet another embodiment of a water pressure system 80 having a pressure tank 12 installed within the well casing 14 of a well 16. FIG. 3A shows the tank 12 at maximum storage capacity, while FIG. 3B shows the tank 12 at minimum storage capacity. This embodiment does not include the use of a relief valve or a flow control valve. Constant water pressure is maintained in the system through the use of a submersible variable speed pump 82.

The water pressure system 80 of FIGS. 3A and 3B, comprises a submersible variable speed pump 82 installed in a well 16 for pumping water from a water bearing aquifer 20 to a pressure tank 12 installed in the well casing 14 of the well 16 for distribution and use. A tank inlet drop pipe 38 preferably connects the output 84 of the submersible variable speed pump 82 to the inlet end 40 of the pressure tank 12. A tank outlet drop pipe 44 preferably connects the outlet end 42 of the pressure tank 12 to a discharge pipe (not shown) for distributing pressurized water from the pressure tank 12. A flow switch and pressure transducer are coupled to the discharge pipe 52 for use in connection with the submersible variable speed pump 82 as is known in the art.

Referring now to FIG. 4, a first embodiment of a pressure tank according to the present invention is shown. This embodiment is equivalent to the pressure tank shown in FIGS. 1A, 1B, 2A, 2B, 3A and 3B. FIGS. 4–8 illustrate the details of pressure tank 12 and of attaching and sealing the flexible diaphragm bladder 58 to the inlet 40 and outlet 42 ends of the tank 12. The bladder 58 preferably includes an inlet opening 88 at an inlet end 92 and an outlet opening 90 at an outlet end 94. The inlet opening 88 of the flexible diaphragm bladder 58 is sealed to the inlet end 40 of the tank 12 with the at least one bottom clamp 68, and the outlet opening 90 of the flexible diaphragm bladder 58 is sealed to the outlet end 42 of the tank 12 with the at least one top clamp 70.

Figure 6:
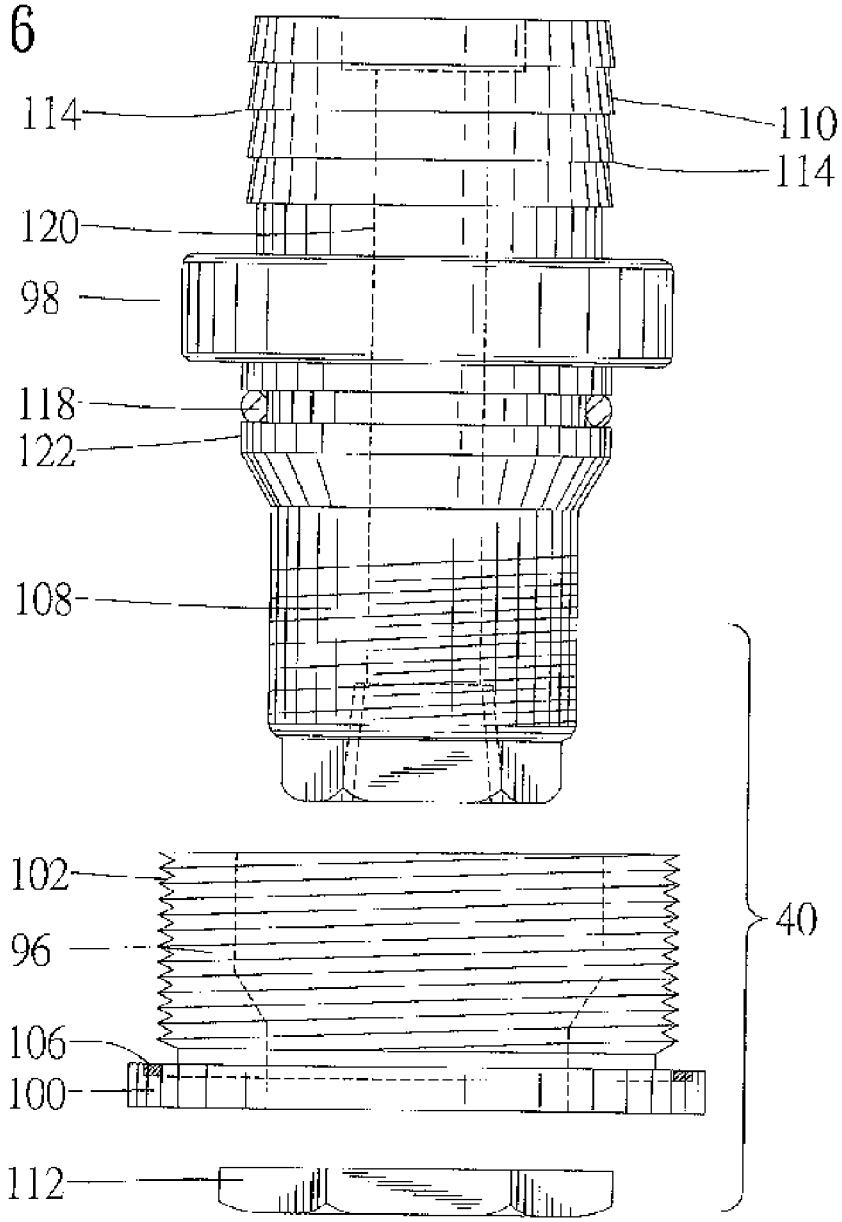
FIG. 6 is an enlarged exploded view of the components of the inlet end cap of the inlet end of FIG. 5.
Figure 7:
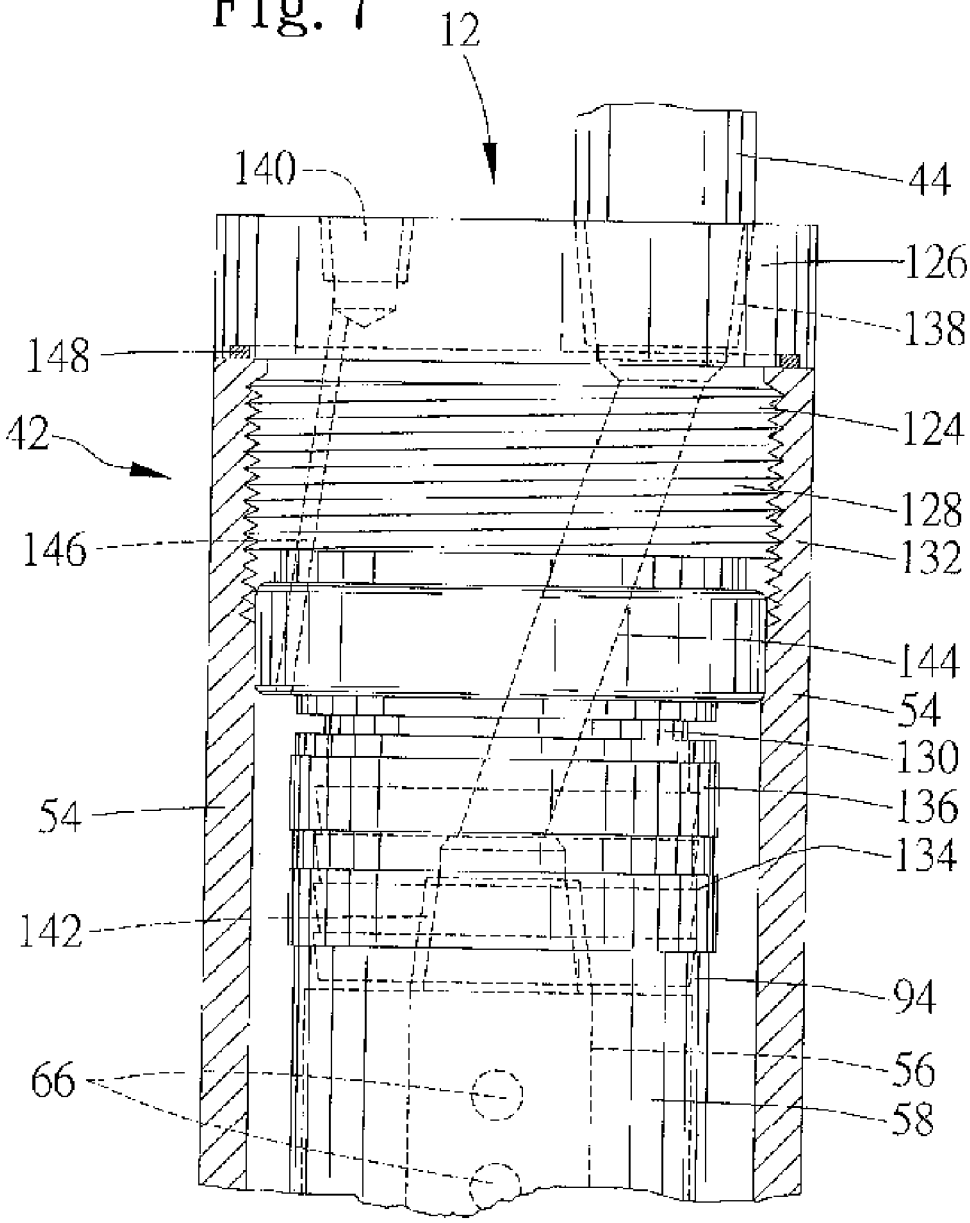
FIG. 7 is an enlarged partial cross-sectional view of the outlet end of the pressure tank of FIG. 4.

FIGS. 5 and 6 illustrate the inlet end 40 of the tank 12. FIG. 5 is an enlarged partial cross-sectional view of the inlet end 40 of the pressure tank 12, while FIG. 6 is an enlarged exploded view of the components of the inlet end 40. The inlet end 40 of the tank 12 preferably includes a cylindrically-shaped, hollow inlet end cap 96 and a cylindrically-shaped, hollow inlet plug 98. The inlet plug 98 is inserted within and mates with and extends through the inlet end cap 96. The inlet end cap 96 includes a bottom flange 100 and a cylindrical top portion 102 with standard pipe threads formed on the cylindrical top portion 102 for attachment to a bottom portion 104 of the outer sidewall 54 of the pressure tank 12. The bottom portion 104 of the outer sidewall 54 having mating pipe threads formed on the inner surface thereof for mating with the inlet end cap 96. The inlet end cap 96 is preferably screwed into the bottom portion 104 of the outer sidewall 54. An o-ring 106 located on an inner portion of the flange 100 seals the end cap 96 to the bottom portion 104 of the outer sidewall 54. The inlet plug 98 has a first end 108 for attachment to the first drop pipe 38 and a second end 110 for attachment to an inlet end 92 of the flexible bladder 58 within the tank 12. The first end 108 has threads for attachment of a fastener 112 to secure the inlet plug 98 in place within the inlet end cap 96. The second end 110 of the plug 98 includes a plurality of ribs 114 for connecting the inlet end 92 of the bladder 58 to the plug 98. At least one clamping device 116 fits over the ribs 114 of the second end 110 of the plug 98 to secure the inlet end 92 of the bladder 58 to the plug 98. The inlet opening 88 of the diaphragm bladder 58 is thereby clamped to the second, ribbed end 110 of the inlet plug 98 with the at least one clamping device 116. An o-ring 118 located around a center portion 122 of the plug 98 seals the connection between the plug 98 and the end cap 96. An opening 120 extending through the inlet plug 98 allows water to flow through the plug 98 to the center pipe 56 within the bladder 58.

Figure 8:
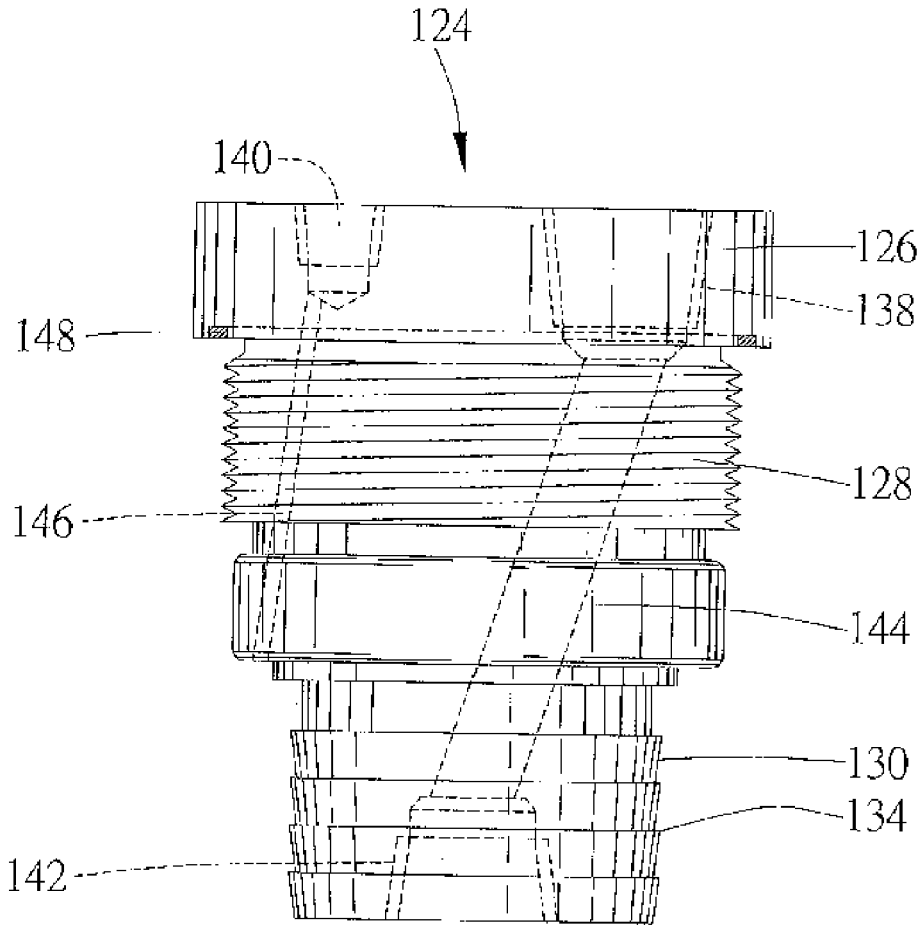
FIG. 8 is an enlarged view of the outlet end cap of the outlet end of FIG. 7.

FIGS. 7 and 8 illustrate the outlet end 42 of the tank 12. FIG. 7 is an enlarged partial cross-sectional view of the outlet end 42 of the tank 12, while FIG. 8 is an enlarged view of an outlet end cap 124 that connects the outlet end 42 of the tank 12 to the tank outlet drop pipe 44. The outlet end cap 124 includes a top flange 126 for enclosing the outlet end 42 of the tank 12, a center portion 128 for securing the outlet end cap 124 to the outer sidewall 54, and a bottom portion 130 for connecting the outlet end cap 124 to an outlet end 94 of the bladder 58. The center portion 128 has threads embedded therein for mating with threads on the inner surface of a top portion 132 of the outer sidewall 54. The bottom portion 130 has ribs 134 for securing the outlet end 94 of the bladder 58 to the outlet end cap 124. At least one clamping device 136 fits over the ribs 134 of the bottom portion 130 to secure the outlet end 94 of the bladder 58 to the outlet end cap 124. The outlet opening 90 of the diaphragm bladder 58 is thereby clamped to the bottom, ribbed end 130 of the outlet end cap 124 with the at least one clamping device 136.

The top flange 126 has connections 138, 140 for connecting the outlet end 42 of the tank 12 to the tank outlet drop pipe 44 and the pressure switch 22. The bottom portion 130 of the outlet end cap 124 has a connection 142 for connecting to the center pipe 56 within the bladder 58. A first opening 144 extending through the outlet end cap 124 between the center pipe connection 142 and the second drop pipe connection 138 allows water to flow from the center pipe 56 within the bladder 58 through the outlet end cap 124 to the tank outlet drop pipe 44. A second opening 146 extending through the flange 126 and the center portion 128 of the outlet end cap 124 allows pressurized air to flow from the pressure tank 12 to the pressure switch 22. An o-ring 148 located on an inner portion of the top flange 126 seals the outlet end cap 124 to the sidewall 54 of the outlet end 42 of the tank 12.

Referring again to FIG. 4, the flexible diaphragm bladder 58 is connected between the inlet plug 98 and the outlet end cap 124. The components of the pressure tank 12 are preferably made out of a non-corrosive sanitary material, such as plastic or PVC to eliminate corrosion and bacterial growth. The flexible diaphragm bladder 58 is preferably made out of butyl rubber.

Figure 9A:
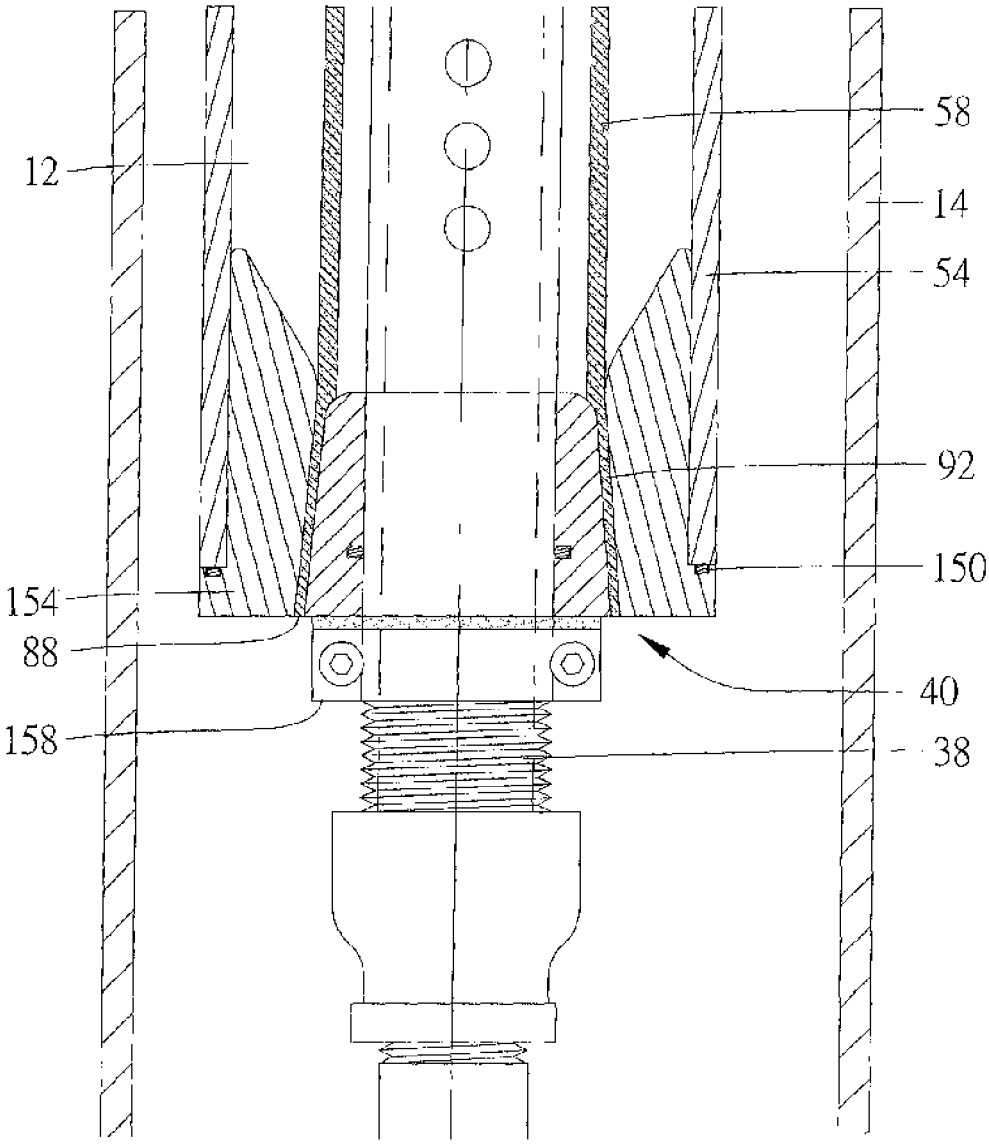
FIG. 9A is an enlarged partial cross-sectional view of an alternative embodiment of an inlet end of a pressure tank.
Figure 9B:
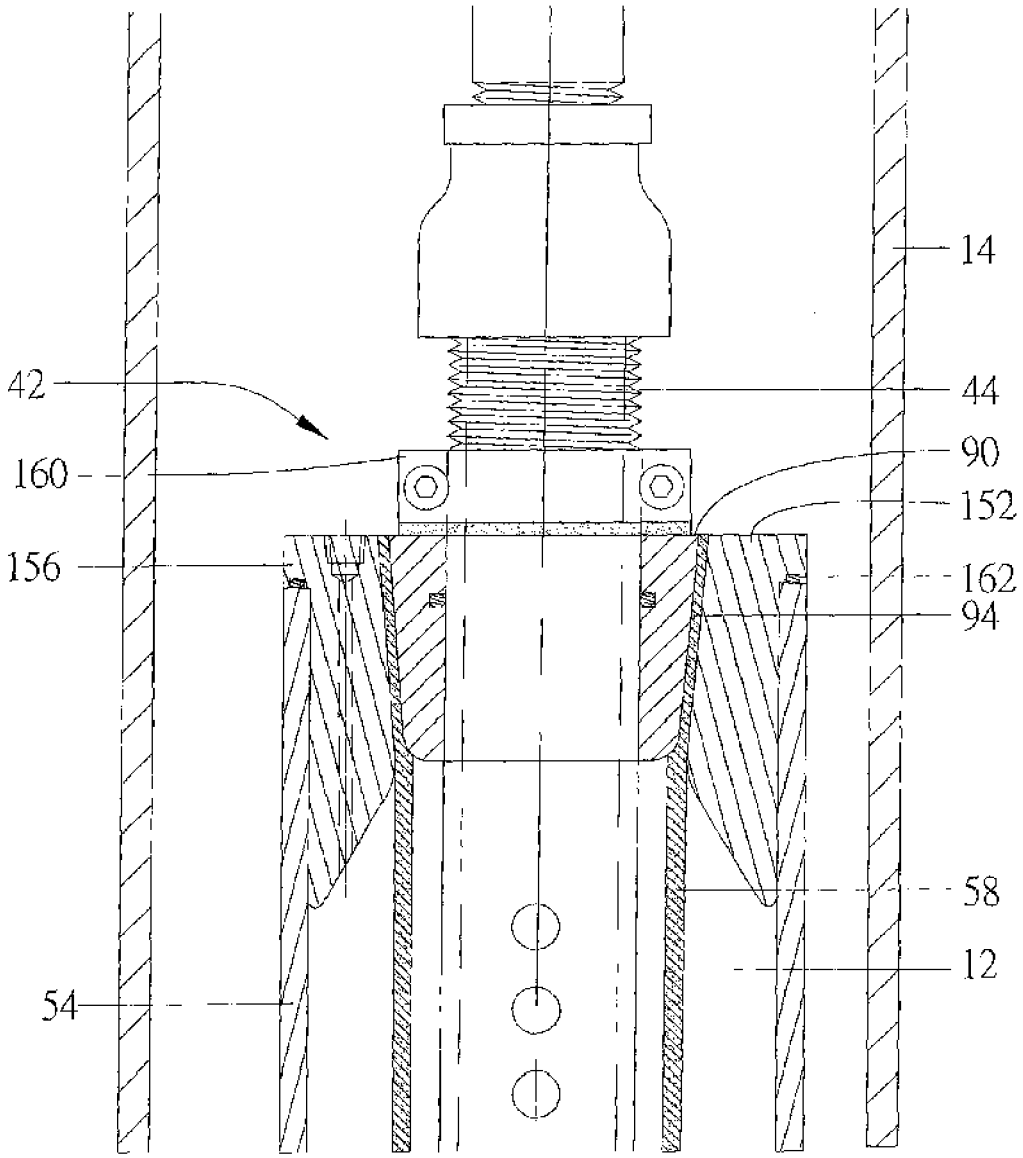
FIG. 9B is an enlarged partial cross-sectional view of an alternative embodiment of an outlet end of a pressure tank.

FIGS. 9A and 9B illustrate another embodiment of attaching and sealing the flexible diaphragm bladder 58 to the outer sidewall 54 and the inlet and outlet ends 40 and 42 of the pressure tank 12. The pressure tank 12 is preferably installed within the well casing 14 of a well. The flexible diaphragm bladder 58 preferably includes an inlet end 92 with an inlet opening 88 and an outlet end 94 with an outlet opening 90. The inlet end 92 of the bladder 58 is sealed between a flexible inlet fitting that forms the end cap 154 of the tank and is secured in place by a fastener assembly 158 that connects to the first drop pipe 38. An o-ring 150 seals the end cap 154 to the top of the sidewall 54. Likewise, the outlet end 94 of the bladder 58 is sealed between a flexible outlet fitting 152 that forms the end cap 156 of the tank and is secured in place by a fastener assembly 160 that connects to the second drop pipe 44. An o-ring 162 seals the end cap 156 to the top of the sidewall 54. This embodiment allows for easy repair and/or replacement of the bladder. The bladder is removed by removing the fastener assemblies 158, 160, removing the end caps 154 and 156, and lifting the bladder 58 out.

Figure 10A:
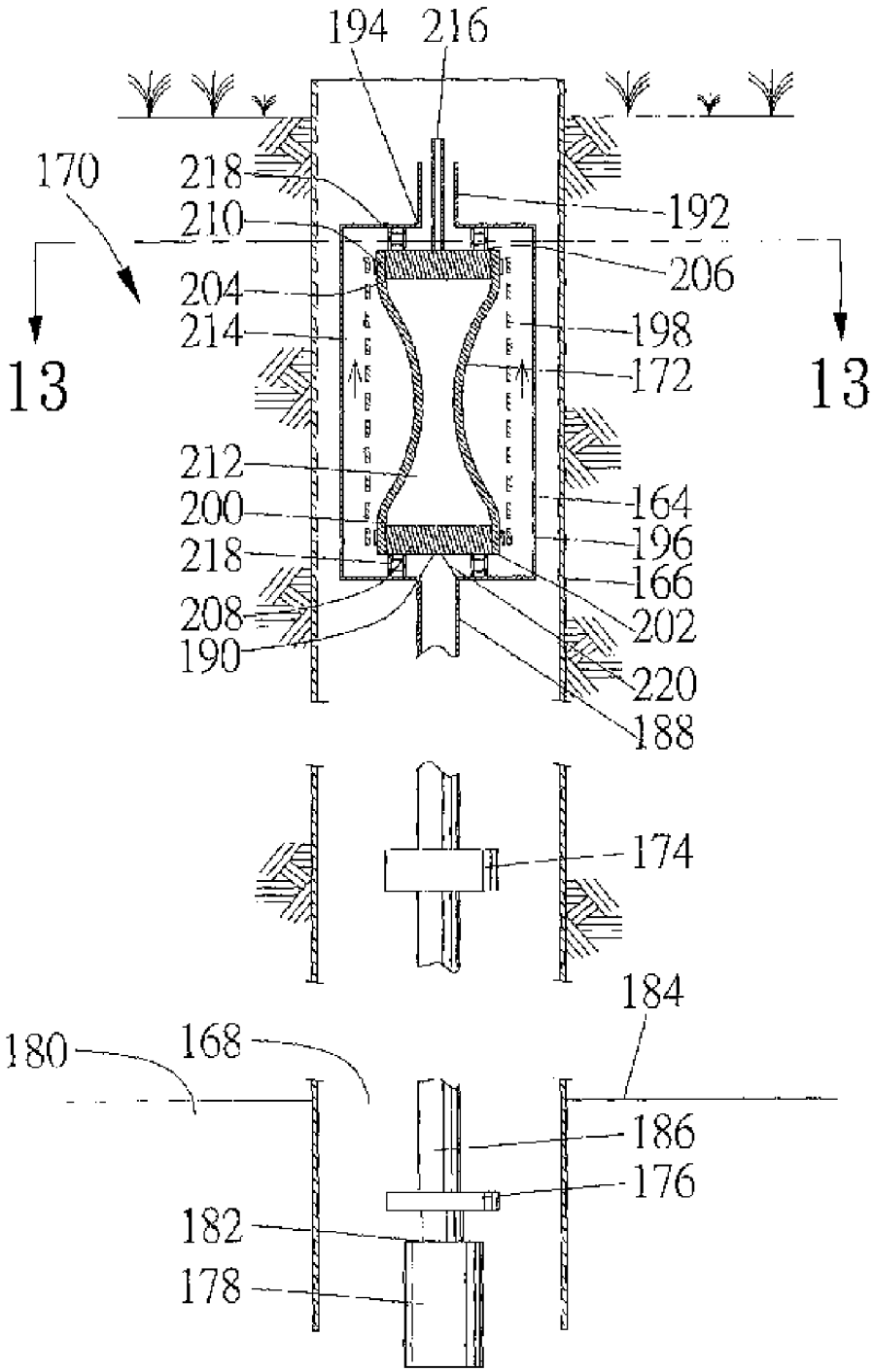
FIG. 10A is a partial cross-sectional schematic representation of a water pressure system similar to the water pressure system of FIG. 1A, showing an alternate embodiment of a pressure tank installed within the well casing of a well at maximum storage capacity.
Figure 10B:
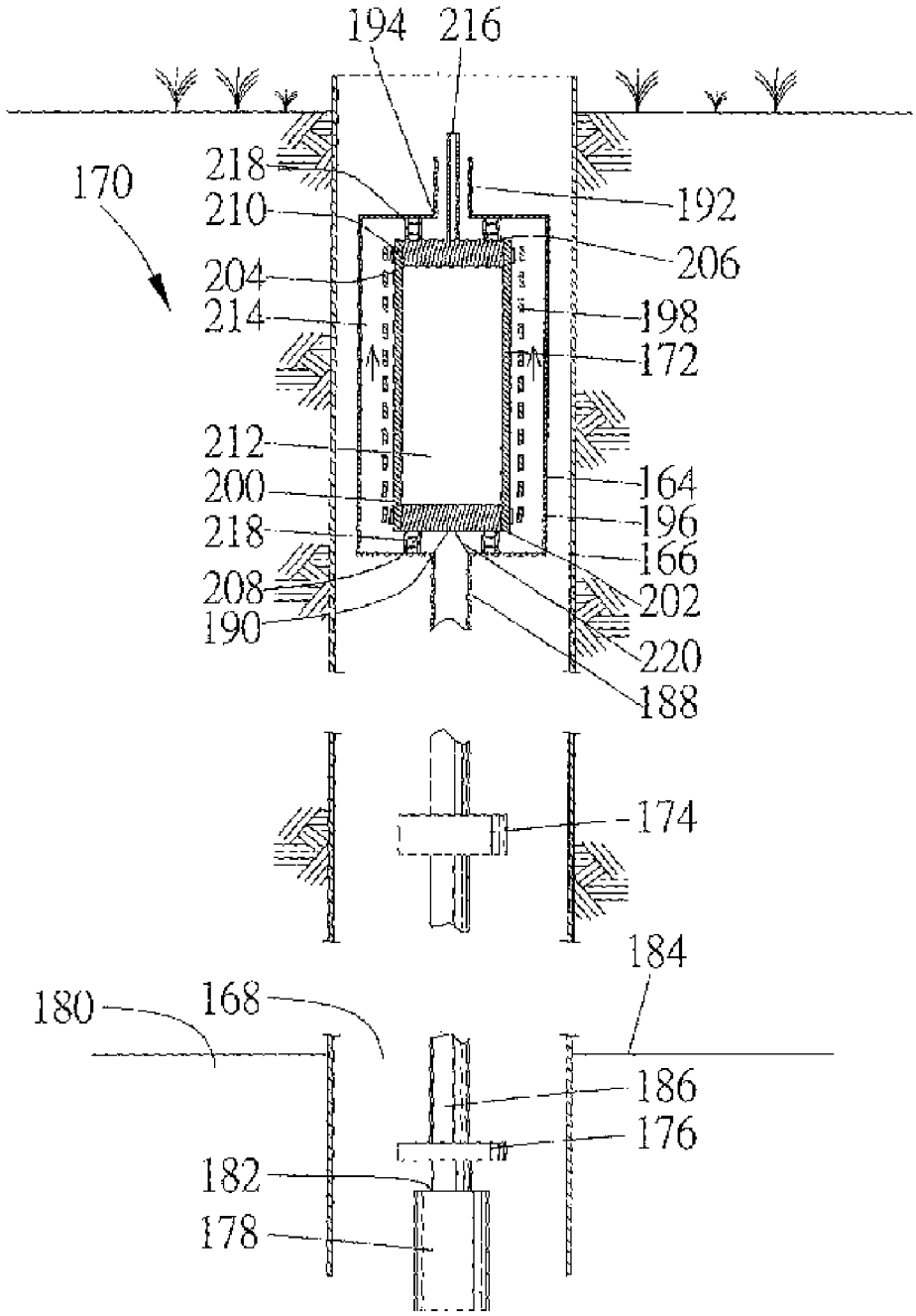
FIG. 10B is a partial cross-sectional schematic representation of the water pressure system of FIG. 10A, showing the pressure tank at minimum storage capacity.

FIGS. 10A and 10B illustrate another embodiment of a water pressure system 170. A pressure tank 164 is installed within the well casing 166 of a well 168. The pressure tank 164 has no center pipe, with water stored on the outside of a flexible diaphragm bladder 172. The pressure tank 164 is connected to a control valve 174, a relief valve 176, and a submersible pump 178. FIG. 10A shows the bladder 172 of the tank 164 at maximum storage capacity, while FIG. 10B shows the bladder 172 of the tank 164 at minimum storage capacity.

The submersible pump 178 installed in the well 168 pumps water from a water bearing aquifer 180 through the relief valve 176, the flow control valve 174 to the pressure tank 164 installed in the well casing 166 of the well 168. The output end 182 of the submersible pump 178 is connected to the relief valve 176. The relief valve 176 is preferably installed below the pumping water level 184 right above the submersible pump 178, so that the relief valve 176 is always under water, preventing mineral deposits from forming on the relief valve 176 that could adversely affect water quality. The relief valve 176 releases excess pressure in the system and limits back pressure from building up in the submersible pump 178, especially on the motor bearings of the pump 178, which could fail if the relief valve 176 was not installed in the system. A first drop pipe 186 preferably connects the relief valve 176 to the flow control valve 174. The flow control valve 174 controls output flow from the pump 178 and relief valve 176. The flow control valve 174 maintains constant water pressure in the system and automatically adjusts the pump's output to match the flow requirements of the system. The flow control valve 174 also extends pump life by eliminating pump cycling, eliminating changes in water pressure and eliminating the need for a large storage pressure tank. A tank inlet drop pipe 188 connects the flow control valve 174 to the inlet end 190 of the pressure tank 164. A tank outlet drop pipe 192 preferably connects the outlet end 194 of the pressure tank 164 to a discharge pipe (not shown) for distributing pressurized water from the pressure tank.

The pressure tank 164 comprises an outer sidewall 196 with an inlet end 190 and an outlet end 194, the flexible diaphragm bladder 172, and a confining tube 198 for supporting the flexible diaphragm bladder 172 in the tank. The inlet end 190 and the outlet end 194 are sealed to the outer sidewall 196 at both ends of the pressure tank 164. The flexible diaphragm bladder 172 includes an inlet end 200 with an inlet opening 202 and an outlet end 204 with an outlet opening 206. An inlet end plug 208 seals the inlet end 200 and inlet opening 202 of the flexible diaphragm bladder 172. An outlet end plug 210 seals the outlet end 204 and outlet opening 206 of the flexible diaphragm bladder 172. The confining tube 198 prevents the bladder 172 from over expanding and allows a passage for water around the bladder 172 when it is fully expanded. An air chamber 212 exists on the inside of the flexible diaphragm bladder 172, and a water chamber 214 exists between the confining tube 198 and the outer sidewall 196. An air valve 216 extending through the tank outlet drop pipe 192 and the outlet end plug 210 allows adjustment of air pressure in the bladder 172. At least one bracket 218 attaches the bladder ends 200 and 204 and plugs 208 and 210 to the outer sidewall 196 of the tank 164 and hold the bladder 172 secure in the pressure tank 164. The brackets 218 are constructed to allow water to pass through and around them. At least one strap attaches the bladder 172 to the plugs 208 and 210 at each end of the bladder 172. The straps are preferably stainless steel. The bladder 172 is preferably made out of butyl or other FDA or NSF approved material. The outer sidewall 196 of the tank 164 can be made of plastic or other non-corrosive material such as stainless steel. An anchor system 220 attaches the bottom end of the bladder 172 and plug 208 to keep the bladder 172 from moving to the top of the pressure tank 164.

In FIG. 10A, the water pressure has the air on the inside of the bladder 172 compressed. In FIG. 10B, the bladder 172 is expanded to the confining tube 198. This tube 198 prevents the bladder 172 from over expanding and sealing off movement of water.

Figure 11A:
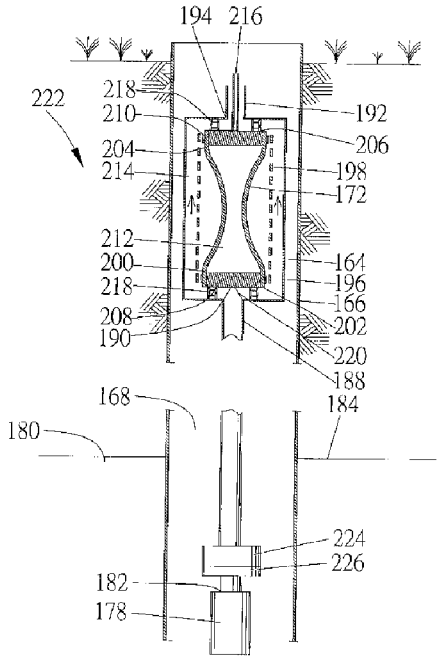
FIG. 11A is a partial cross-sectional schematic representation of a water pressure system similar to the water pressure system of FIG. 2A, showing an alternate embodiment of a pressure tank installed within the well casing of a well at maximum storage capacity.
Figure 11B:
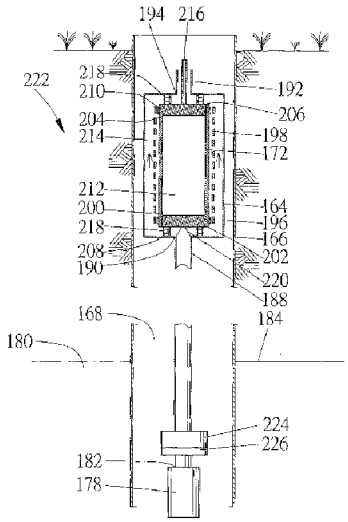
FIG. 11B is a partial cross-sectional schematic representation of the water pressure system of FIG. 11A, showing the pressure tank at minimum storage capacity.

FIGS. 11A and 11B illustrate another embodiment of a water pressure system 222 having a pressure tank 164 installed within the well casing 166 of a well 168. The pressure tank 164 is connected to a control valve 224 with an integral relief valve 226 incorporated therein and a submersible pump 178. FIG. 11A shows the bladder 172 of the tank 164 at maximum storage capacity, while FIG. 11B shows the bladder 172 of the tank 164 at minimum storage capacity.

The output 182 of the submersible pump 178 is connected to the flow control valve 224 with the integral relief valve 226. The flow control valve 224 with integral relief valve 226 is preferably installed below the pumping water level 184 right above the submersible pump 178, so that the flow control valve 224 with integral relief valve 226 is always under water, preventing mineral deposits from forming on the relief valve 226 that could adversely affect water quality. The relief valve 226 releases excess pressure in the system and limits back pressure from building up in the submersible pump 178, especially on the motor bearings of the pump 178, which could fail if the relief valve 226 was not installed in the system 222. The flow control valve 224 controls output flow from the pump 178. The flow control valve 224 maintains constant water pressure in the system 222 and automatically adjusts the pump's output to match the flow requirements of the system 222. The flow control valve 224 also extends pump life by eliminating pump cycling, eliminating changes in water pressure and eliminating the need for a large storage pressure tank. A tank inlet drop pipe 188 connects the flow control valve 224 with integral relief valve 226 to the inlet end 190 of the pressure tank 164. A tank outlet drop pipe 192 preferably connects the outlet end 192 of the pressure tank 164 to a discharge pipe (not shown) for distributing pressurized water from the pressure tank 164. The pressure tank 164 is the same as that shown in FIGS. 10A and 10B.

Figure 12A:
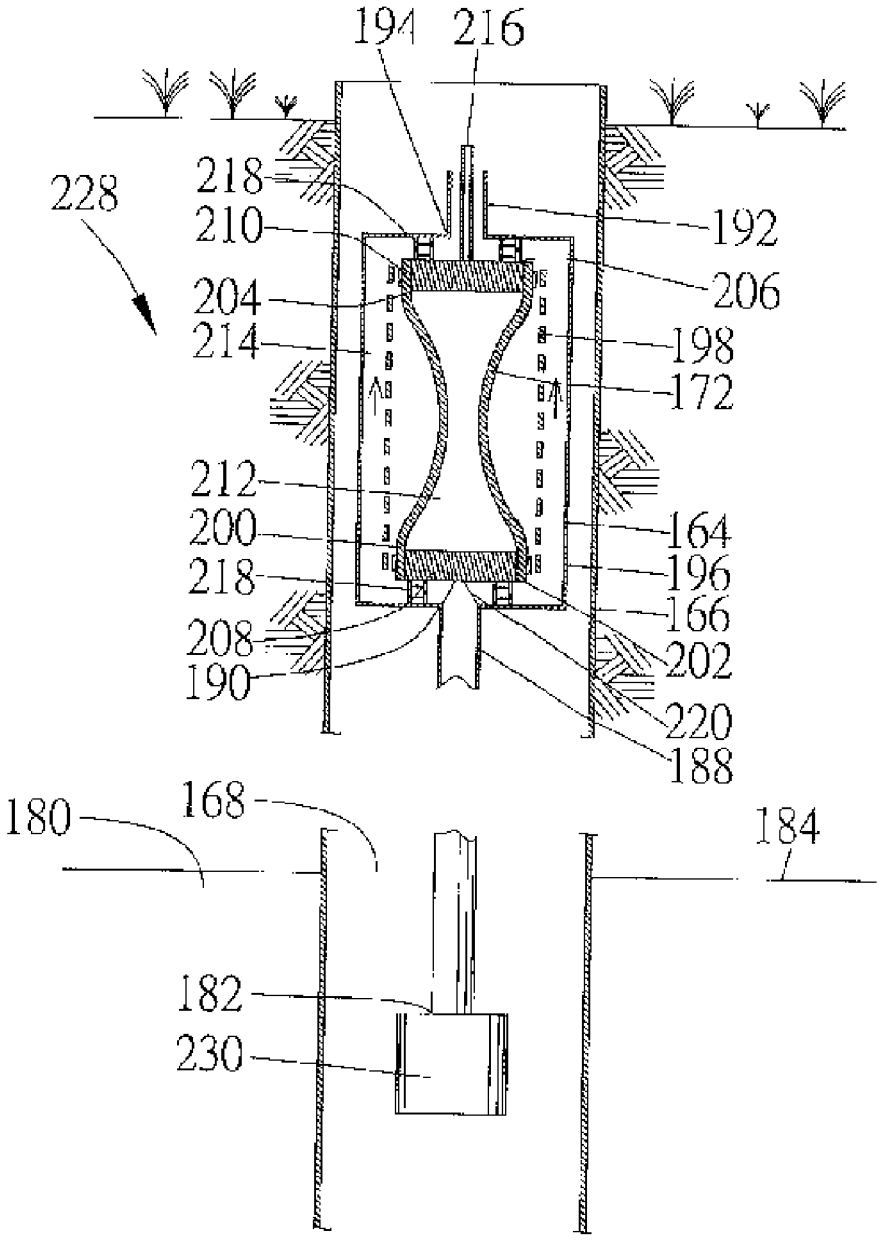
FIG. 12A is a partial cross-sectional schematic representation of a water pressure system similar to the water pressure system of FIG. 3A, showing an alternate embodiment of a pressure tank installed within the well casing of a well at maximum storage capacity.
Figure 12B:
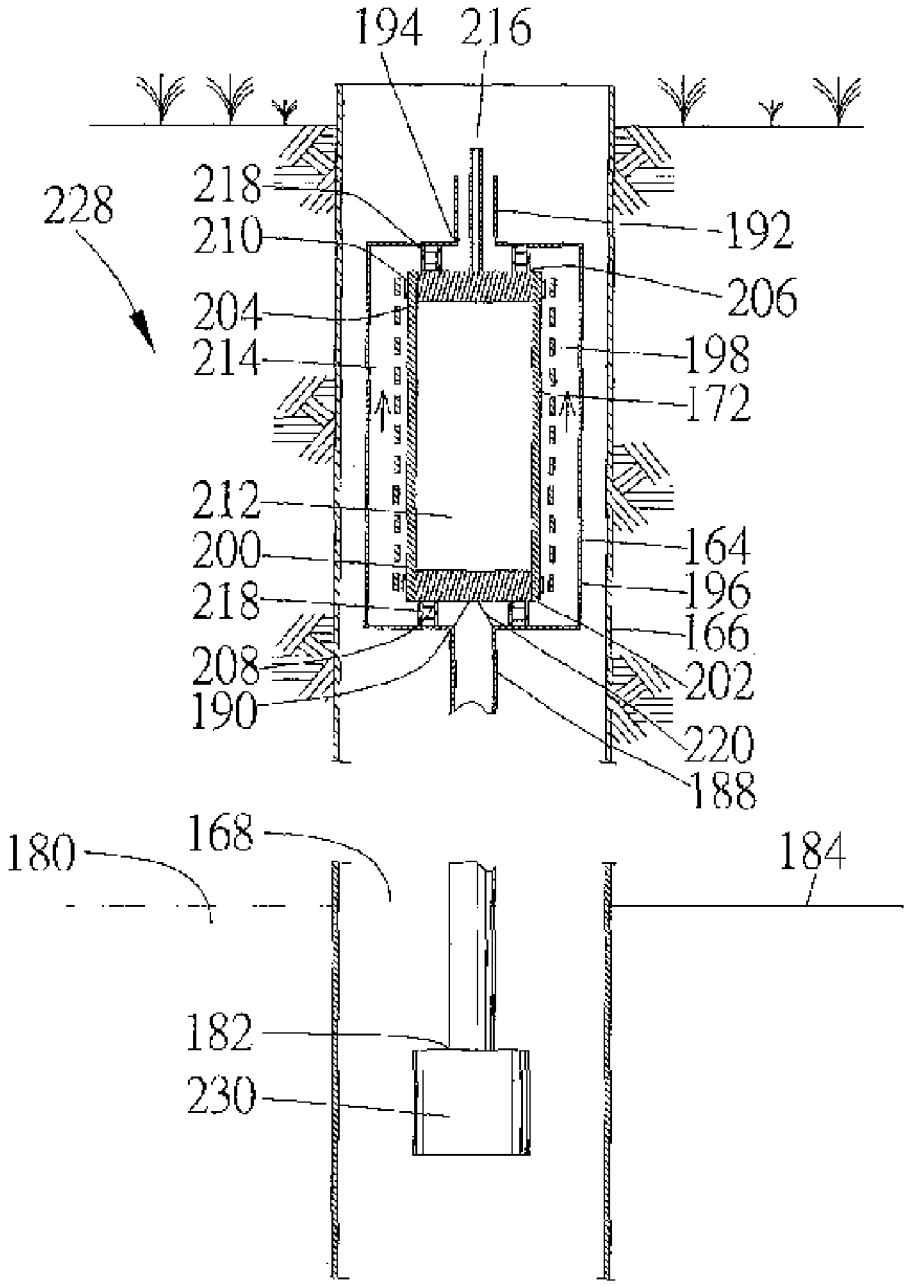
FIG. 12B is a partial cross-sectional schematic representation of the water pressure system of FIG. 12A, showing the pressure tank at minimum storage capacity.
Figure 13:
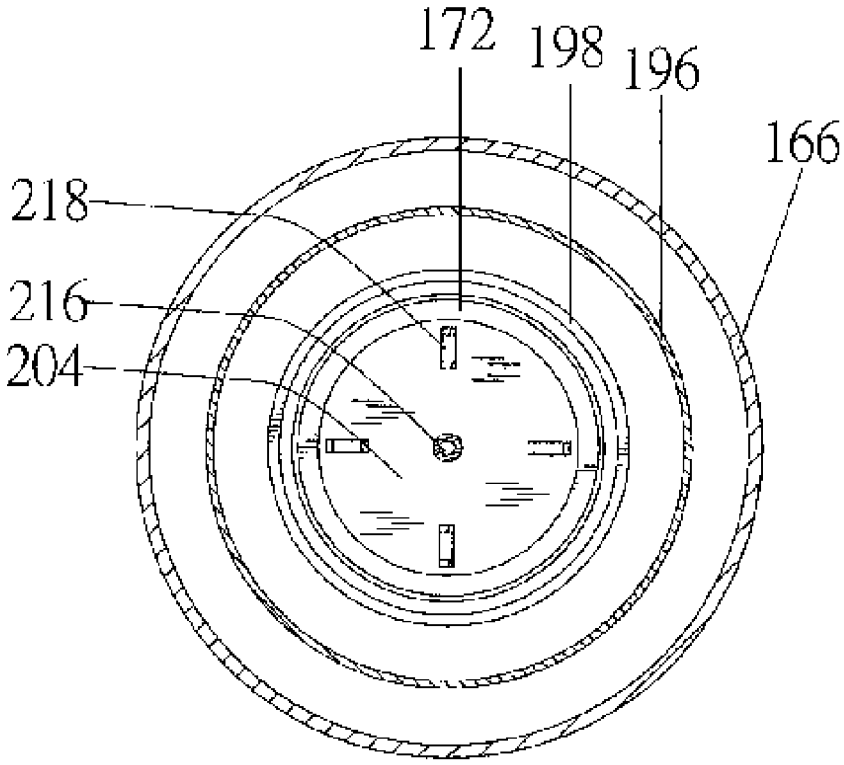
FIG. 13 is a cross-sectional view of the pressure tank of FIGS. 10A, 10B, 11A, 11B, 12A and 12B taken along line 13—13 of FIG. 10A.

FIGS. 12A and 12B illustrate another embodiment of a water pressure system 228 having a pressure tank 164 installed within the well casing 166 of a well 168. The pressure tank 164 is connected to a variable speed submersible pump 230. FIG. 12A shows the bladder 172 of the tank 164 at maximum storage capacity, while FIG. 12B shows the bladder 172 of the tank 164 at minimum storage capacity.

In the water pressure system of FIGS. 12A and 12B, the submersible variable speed pump 230 installed in well 168 pumps water from a water bearing aquifer 180 to the pressure tank 164 installed in the well casing 166 of the well 168 for distribution and use. A tank inlet drop pipe 188 preferably connects the output 182 of the submersible variable speed pump 230 to the inlet end 190 of the pressure tank 164. A tank outlet drop pipe 192 preferably connects the outlet end 194 of the pressure tank 164 to a discharge pipe (not shown) for distributing pressurized water from the pressure tank 164. The pressure tank 164 is the same as that shown in FIGS. 10A and 10B.

While the invention has been described with reference to preferred embodiments, those skilled in the art will appreciate that certain substitutions, alterations and omissions may be made without departing from the spirit oft-he invention. Accordingly, the foregoing description is meant to be exemplary only, and should not limit the scope of the invention set forth in the following claims.

What is claimed is:

1. A water pressure system comprising:

a submersible pump for pumping water from a water bearing aquifer;

a pressure tank installed in a well casing of the water pressure system and connected to the submersible pump with a drop pipe, the pressure tank including an inlet end, an outlet end, and an outer sidewall, with the pressure tank further including an expandable diaphragm bladder located within the outer sidewall of the tank, with the pressure tank being fillable with water from the submersible pump for storing a reserve of water, with the pressure tank being precharged with pressurized air with the expandable diaphragm bladder stretching or contracting as water pressure varies inside the pressure tank; and a pressure switch coupled to the pressure tank and for monitoring pressure in the pressure tank and controlling operation of the submersible pump.

2. The water pressure system of claim 1 wherein the pressure switch is coupled to an open area within the outer sidewall of the pressure tank.

3. The water pressure system of claim 1 wherein the expandable diaphragm bladder is fillable with water from the submersible pump for storing a reserve of the pressure tank.

4. The water pressure system of claim 3 wherein the pressure tank is small enough to fit underground within the well casing of a water well.

5. The water pressure system of claim 3 wherein the pressure tank can draw down approximately one to three gallons of water.

6. The water pressure system of claim 3 wherein the expandable diaphragm bladder is made of butyl rubber.

7. The water pressure system of claim 3 wherein the pressure tank is made of PVC.

8. The water pressure system of claim 3 further comprising a flow control valve connected between the submersible pump and the pressure tank for maintaining constant water pressure in the system.

9. The water system of claim 3 wherein the submersible pump is a variable speed pump for maintaining constant water pressure in the system.

10. A water pressure system for use with underground water wells comprising:

a submersible pump installed in an underground well of a water pressure system;

a first drop pipe having a first end and a second end opposite the first end, the first end connected to the submersible pump for pumping water from a water bearing aquifer;

a flow control valve connected to the second end of the first drop pipe to maintain the flow of water in the system at a constant pressure;

a pressure tank installed in a well casing of the water pressure system and connected to the second end of the first drop pipe, the pressure tank including an inlet end connected to the flow control valve, an outlet end, and an outer sidewall, with the pressure tank further including an expandable diaphragm bladder located within the outer sidewall of the tank, with the pressure tank being fillable with water from the submersible pump for storing a reserve of water, with the pressure tank being precharged with pressurized air with the expandable diaphragm bladder stretching or contracting as water pressure varies inside the pressure tank;

a second drop pipe having a first end and a second end opposite the first end, with the first end connected to the outlet end of the pressure tank;

a pitless adapter having an inlet connected to the second end of the second drop pipe, and an outlet connected to a discharge pipe; and a pressure switch coupled to the pressure tank and for monitoring pressure in the pressure tank and controlling operation of the submersible pump.

11. The water pressure system of claim 10 wherein the pressure switch is coupled to an open area within the outer sidewall of the pressure tank.

12. The water pressure system of claim 10 wherein the expandable diaphragm bladder is fillable with water from the submersible pump for storing a reserve of the pressure tank.

13. The water pressure system of claim 12 wherein the pressure tank is small enough to fit in the well casing of a water well.

14. The water pressure system of claim 12 wherein the pressure tank can draw down approximately one to three gallons of water.

15. The water pressure system of claim 12 wherein the expandable bladder is made of butyl rubber.

16. The water pressure system of claim 12 wherein the pressure tank is made of PVC.

17. A water pressure system comprising;

a variable speed submersible pump installed in a water well;

a pressure tank installed in a well casing of the water pressure system and connected to the variable speed submersible pump with a drop pipe, the pressure tank including an inlet end, an outlet end, and an outer sidewall, with the pressure tank further including an expandable diaphragm bladder located within the outer sidewall of the tank, with the pressure tank being fillable with water from the submersible pump for storing a reserve of water, with the pressure tank being precharged with pressurized air with the expandable diaphragm bladder stretching or contracting as water pressure varies inside the pressure tank, and a pressure switch coupled to the pressure tank and for monitoring pressure in the pressure tank and controlling the speed of the variable speed submersible pump.

18. The water pressure system of claim 17 wherein the pressure switch is coupled to an open area within the outer sidewall of the pressure tank.

19. The water pressure system of claim 17 wherein the expandable diaphragm bladder is fillable with water from the submersible pump for storing a reserve of the pressure tank.

20. The water pressure system of claim 19 wherein the pressure tank is small enough to fit in the well casing of a water well.

* * * * *